US012158059B2

(12) United States Patent
Turley et al.

(10) Patent No.: US 12,158,059 B2
(45) **Date of Patent: *Dec. 3, 2024**

(54) RUNNING TOOL FOR A LINER STRING

(71) Applicant: Weatherford Technology Holdings, LLC, Houston, TX (US)

(72) Inventors: Rocky A. Turley, Houston, TX (US); Mark J. Murray, Sugar Land, TX (US); Mike A. Luke, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 82 days.

This patent is subject to a terminal disclaimer.

(21) Appl. No.: 17/894,790

(22) Filed: Aug. 24, 2022

(65) Prior Publication Data

US 2023/0131175 A1 Apr. 27, 2023

Related U.S. Application Data

(63) Continuation of application No. 16/837,034, filed on Apr. 1, 2020, now Pat. No. 11,519,244.

(51) Int. Cl.

| | |
|---|---|
| ***E21B 43/10*** | (2006.01) |
| ***E21B 23/04*** | (2006.01) |
| *E21B 33/12* | (2006.01) |

(52) U.S. Cl.

CPC ..... *E21B 43/10* (2013.01); *E21B 23/042* (2020.05); *E21B 33/12* (2013.01)

(58) Field of Classification Search

CPC ..... E21B 43/10; E21B 23/042; E21B 34/10

See application file for complete search history.

(56) References Cited

U.S. PATENT DOCUMENTS 5,360,069 A 11/1994 Schmuck et al.
5,582,253 A 12/1996 Fraser
(Continued)

FOREIGN PATENT DOCUMENTS

EP 2873801 A1 5/2015
WO 2002097234 A1 12/2002
(Continued)

OTHER PUBLICATIONS

International Search Report and Written Opinion in related application PCT/US2021/022183 dated Jun. 22, 2021.
(Continued)

*Primary Examiner* — David Carroll
(74) *Attorney, Agent, or Firm* — Peter V. Schroeder; Booth Albanesi Schroeder PLLC

(57) ABSTRACT

A liner string for a wellbore includes a liner hanger assembly (LHA) and a liner hanger deployment assembly (LHDA) releasably attached to the LHA. The LHDA includes a central bore and a running tool moveable from a locked position to an unlocked position, the running tool including a flow path in communication with the central bore. The liner string further includes a chamber disposed between the LHDA and LHA, wherein the chamber is in selective fluid communication with the flow path. Wherein, when the flow path is closed, the chamber is isolated from the central bore, and when the flow path is open, the flow path provides fluid communication between central bore and chamber.

20 Claims, 23 Drawing Sheets

(56) References Cited

U.S. PATENT DOCUMENTS

| | | | |
|---|---|---|---|
| 5,813,458 | A | 9/1998 | Smith, Jr. et al. |
| 5,839,866 | A | 11/1998 | Moen et al. |
| 6,053,244 | A | 4/2000 | Dybevik et al. |
| 6,065,536 | A | 5/2000 | Gudmestad et al. |
| 6,241,018 | B1 | 6/2001 | Eriksen |
| 6,241,023 | B1 | 6/2001 | Krauss et al. |
| 6,408,945 | B1 | 6/2002 | Telfer |
| 6,467,547 | B2 | 10/2002 | Maguire et al. |
| 6,571,880 | B1 | 6/2003 | Butterfield, Jr. et al. |
| 6,681,860 | B1 | 1/2004 | Yokley et al. |
| 6,739,398 | B1 | 5/2004 | Yokley et al. |
| 6,907,936 | B2 | 6/2005 | Fehr et al. |
| 7,114,573 | B2 | 10/2006 | Hirth et al. |
| 7,182,135 | B2 | 2/2007 | Szarka |
| 7,225,870 | B2 | 6/2007 | Pedersen et al. |
| 7,533,727 | B2 | 5/2009 | Barton et al. |
| 7,748,760 | B2 | 7/2010 | Kushida et al. |
| 7,766,088 | B2 | 8/2010 | Saucier et al. |
| 8,181,701 | B2 | 5/2012 | Yokley et al. |
| 8,327,930 | B2 | 12/2012 | Rondeau |
| 8,393,401 | B2 | 3/2013 | Yokley et al. |
| 8,534,368 | B2 | 9/2013 | Reimert et al. |
| 8,997,858 | B2 | 4/2015 | Tom |
| 9,068,413 | B2 | 6/2015 | Doane |
| 9,068,414 | B2 | 6/2015 | Doane |
| 9,074,437 | B2 | 7/2015 | Stingerie et al. |
| 9,080,404 | B2 | 7/2015 | Kalb et al. |
| 9,217,309 | B2 | 12/2015 | Kalb et al. |
| 9,243,492 | B2 | 1/2016 | Fraser |
| 9,267,348 | B2 | 2/2016 | Ingram et al. |
| 9,322,235 | B2 | 4/2016 | Turley et al. |
| 9,428,998 | B2 | 8/2016 | Turley et al. |
| 9,518,452 | B2 | 12/2016 | Turley et al. |
| 9,650,854 | B2 | 5/2017 | Devarajan et al. |
| 9,771,793 | B2 | 9/2017 | Fraser et al. |
| 9,816,357 | B2 | 11/2017 | Abraham |
| 9,995,099 | B2 | 6/2018 | Halfmann |
| 10,012,046 | B2 | 7/2018 | Ewing et al. |
| 10,273,780 | B2 | 4/2019 | Garcia et al. |
| 10,301,907 | B2 | 5/2019 | Budde |
| 2008/0257560 | A1 | 10/2008 | Brisco et al. |
| 2009/0272544 | A1 | 11/2009 | Giroux et al. |
| 2012/0175133 | A1 | 7/2012 | Nikiforuk |
| 2012/0222861 | A1 | 9/2012 | Eriksen |
| 2014/0196912 | A1 | 7/2014 | Turley et al. |
| 2014/0305662 | A1* | 10/2014 | Giroux ..... E21B 43/10 166/65.1 |
| 2016/0230505 | A1 | 8/2016 | Garcia et al. |
| 2016/0326832 | A1 | 11/2016 | Watson et al. |
| 2018/0223615 | A1 | 8/2018 | Luke et al. |
| 2021/0115757 | A1 | 4/2021 | Murray et al. |

FOREIGN PATENT DOCUMENTS

| | | | |
|---|---|---|---|
| WO | 2004083590 | A2 | 9/2004 |
| WO | 2015156819 | A1 | 10/2015 |

OTHER PUBLICATIONS

Non-Final Office Action in US 20210115757 dated May 12, 2021.
Final Office Action in US 20210115757 dated Dec. 27, 2021.
Invitation to Pay Additional Fees in related application PCT/US2020/055501 dated Dec. 19, 2020.
International Search Report and Written Opinion in related applicaiton PCT/US2020/055501 dated Feb. 2, 2021.
Examination Report in related application GC 2020-40674 dated Nov. 8, 2021.
Weatherford; Weatherford Direct; Product catalogue; pp. 1-203 (Kobe Knockout Plug, pp. 91, 166); retrieved from the internet:<https://www.weatherforddirect.com/weatherford/groups/public/documents/weatherforddirect/wft_direct_sdc_catalog.pdf>.
Weatherford; Liner Systems; Product catalogue; 2 pages (Weatherford Premium Hydraulic-Rotating (WPHR) Liner Hanger; retrieved from the Internet: https://www.weatherford.com/documents/technical-specification-sheet/products-and-services/drilling/wphr-liner-hanger/.
Intellectual Property Office of Australia, Examination Report No. 1, for AU Application 2021246951, dated Jan. 11, 2024. 4 pages.

* cited by examiner 100
200
22
50

24
400
32
300
22

24
520

26
700
600
24

RUNNING TOOL FOR A LINER STRING

CROSS-REFERENCE TO RELATED APPLICATIONS

This Application is a Continuation of patent application Ser. No. 16/837,034, filed on Apr. 1, 2020, which is herein incorporated by reference in its entirety.

BACKGROUND

Field

Embodiments of the present disclosure generally relate to a running tool for a liner string.

Description of the Related Art

Liner hangers are used to suspend a liner from another tubular string in a wellbore. Conventional hydraulic liner hangers are actuated in response to pressure above a threshold to set slips. The liner strings are long and the wellbore can have deviations and turns. During run-in, an increase in fluid circulation through the liner string may be necessary to facilitate moving the liner string through the deviations and/or turns. The increase in fluid circulation in the liner string may inadvertently actuate the liner hanger in the wellbore above the intended setting location. Unintended setting of the liner hanger results in the need to remove the liner string and to conduct a subsequent wellbore operation.

There exists a need for a liner hanger running tool that prevents premature actuation of the liner hanger.

SUMMARY

The present disclosure generally relates to a running tool for a liner string and methods for completing downhole operations.

In one embodiment, a liner string for a wellbore includes a liner hanger assembly (LHA) and a liner hanger deployment assembly (LHDA) releasably attached to the LHA. The LHDA includes a central bore and a running tool moveable from a locked position to an unlocked position, the running tool including a flow path in communication with the central bore. The liner string further includes a chamber disposed between the LHDA and LHA, wherein the chamber is in selective fluid communication with the flow path. Wherein, when the flow path is closed, the chamber is isolated from the central bore, and when the flow path is open, the flow path provides fluid communication between central bore and chamber.

In one embodiment, a liner string for a wellbore includes a LHA and a LHDA. The LHDA includes a running tool attached to the LHA in a locked position and released from the LHA in an unlocked position. The running tool including a tubular body having a bore, a body sleeve disposed about the tubular body, a shearable plug having a flow path and a closure member, wherein the closure member blocks the flow path from fluid communication with the bore, and a first sleeve moveable from a closed position to an open position to remove the closure member to expose the flow path. The liner string further includes a chamber formed between the LHA and LHDA and isolated from fluid communication with the bore when the first sleeve is in the closed position and when the running tool is in the unlocked position.

In one embodiment, a liner string includes a LHA and a LHDA. The LHDA includes a running tool releasably attached to the LHA. The running tool includes a tubular body having a bore, the tubular body having a first port and a second port in fluid communication with the bore. The running tool further includes a piston assembly including a piston sleeve having an opening, wherein the piston sleeve is moveable from a closed position to an open position, and a seal assembly disposed between the first port and the second port, the seal assembly configured to block the opening when the piston sleeve is in the closed position. The liner string further includes a chamber formed between the LHA and LHDA, wherein the chamber is isolated from fluid communication with the bore when the piston sleeve is in the closed position, and is in fluid communication with the bore when the piston sleeve is in the open position.

In one embodiment, a method of operating a liner string includes deploying a liner string comprising a LHDA attached to a LHA into a wellbore, wherein a chamber is disposed between the LHDA and LHA and is isolated from a central bore of the LHDA. The method further includes actuating a running tool of the LHDA to open a flow path between the chamber and the central bore. The method further includes increasing pressure in the chamber to set a liner hanger of the LHA after actuating the running tool.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, may admit to other equally effective embodiments.

FIG. 2 illustrates a cross sectional view of a bonnet and a connector.

FIG. 3A illustrates a cross sectional view of a running tool.

FIG. 4 illustrates a cross sectional view of a packer.

FIG. 5 illustrates a cross sectional view of a liner hanger and a packoff.

FIG. 6A illustrates the portion of the liner string within the circled region of FIG. 5 to show the packoff in the engaged position. FIG. 6B illustrates the packoff in the disengaged position.

FIG. 7 illustrates a cross sectional view of a seal bypass.

FIGS. 8A-8D illustrate a cross sectional view of the liner string disposed in a casing.

FIGS. 9A-13A illustrate an operational sequence of the portion of the liner hanger seen in FIG. 8A.

FIGS. 9B-13B illustrate an operational sequence of the portion of the liner hanger seen in FIG. 8B.

FIGS. 9C-13C illustrate an operational sequence of the portion of the liner hanger seen in FIG. 8D.

FIGS. 9D-13D illustrate an operational sequence of the portion of the liner hanger seen in FIG. 8D.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Figure 1:
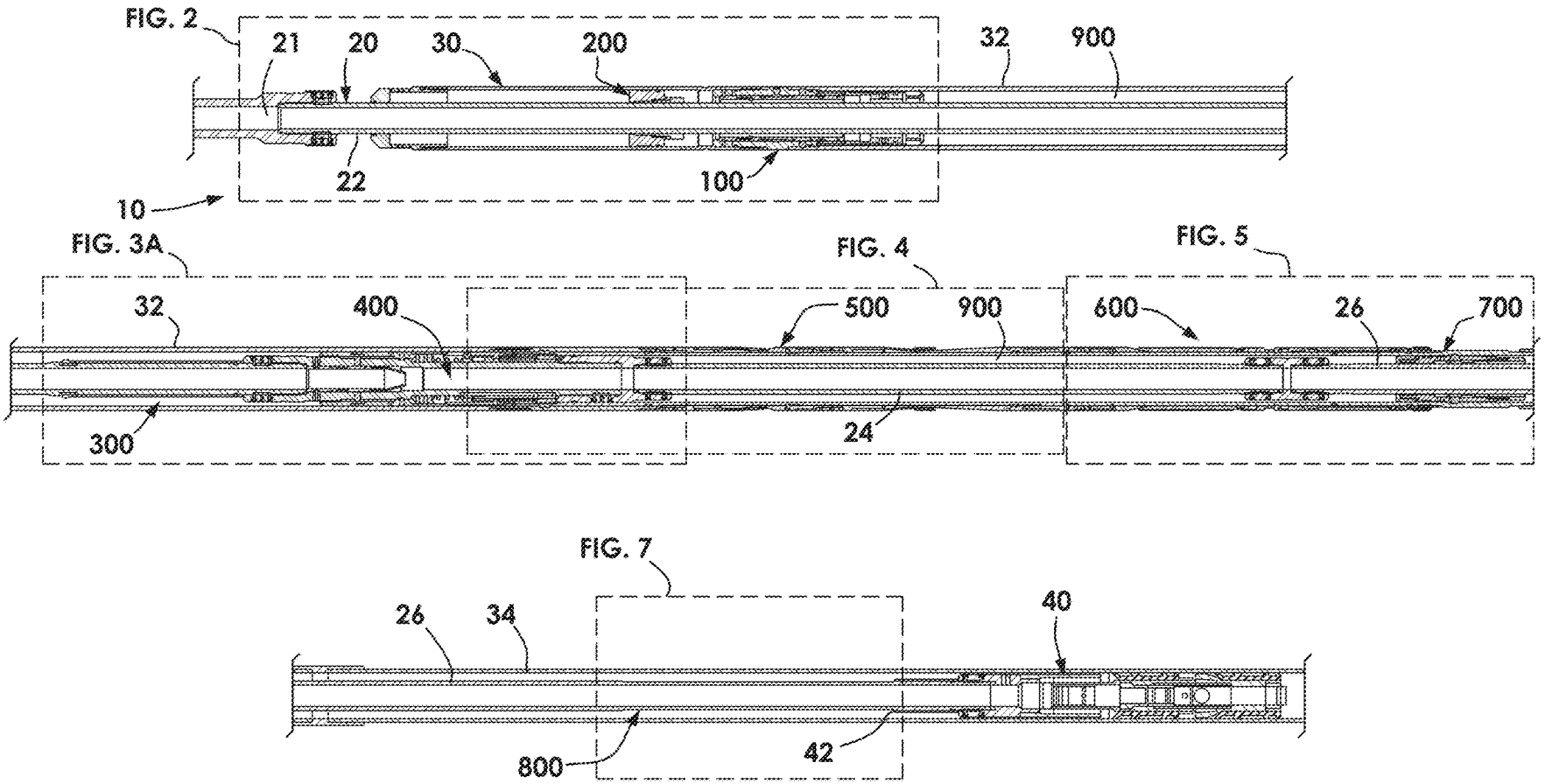
FIG. 1 illustrates a cross sectional view of a liner string having a liner hanger deployment assembly and a liner hanger assembly.

FIG. 1 illustrates a liner string 10 ready to be run into a wellbore. The liner string 10 includes a LHDA 20 and a LHA 30. As shown in FIG. 1, the LHDA 20 is disposed in the LHA 30. The LHDA 20 is releasably attached to the LHA 30. After the liner string 10 has been run into the wellbore, the LHDA 20 is released from the LHA 30 so that the LHDA 20 can be retrieved to the surface while the LHA 30 is left in the wellbore.

The LHDA 20 may include a connector 100, a bonnet 200, a packer actuator 300, a running tool 400, a packoff 700, a plug assembly 40, a first tubular 22, a second tubular 24, a third tubular 26, and a seal bypass 800. The LHDA 20 has a central bore 21. One end of the first tubular 22 is connected to a tubular string suspended from the surface while the other end is connected to the running tool 400. One end of the second tubular 24 is connected to the running tool 400 while the other end is connected to one end of the third tubular 26. The other end of the third tubular 26 is connected to the plug assembly 40. The first tubular 22, second tubular 24, and third tubular 26 may each be a one integral component. In some embodiments, the first tubular 22, the second tubular 24, and the third tubular 26 may each be formed from multiple sections.

The LHA 30 may include a polished bore receptacle (PBR) 32, a liner 34, a packer 500, and a liner hanger 600. The LHA 30 may also include a float collar (not shown) and float shoe (not shown) at a lower end.

As shown in FIG. 1, a chamber 900 is formed between the LHDA 20 and the LHA 30. During run-in of the liner string 10, the LHDA 20 is disposed in the LHA 30. The LHDA 20 is attached to the LHA 30 by the engagement of the connector 100 with the PBR 32 and the engagement of the running tool 400 with the LHA 30, such as with the packer 500. The chamber 900 is isolated from the annulus surrounding the liner string 10 and the central bore 21 of the LHDA 20. Circulation through the liner string 10 may be increased during run-in to facilitate moving the liner string 10 through deviations and/or turns in the wellbore. The running tool 400 prevents premature actuation of the liner hanger 600 during run-in of the liner string 10. Once run-in of the liner string 10 is complete, the running tool 400 is actuated to allow fluid communication between the central bore 21 and the chamber 900. Once fluid communication between the central bore 21 and the chamber 900 is established, the liner hanger 600 may be actuated in response reaching a pressure threshold. In some embodiments, the running tool 400 can be actuated prior to the completion of run-in once the liner string 10 is close to the setting depth of the liner hanger 600.

Figure 2:
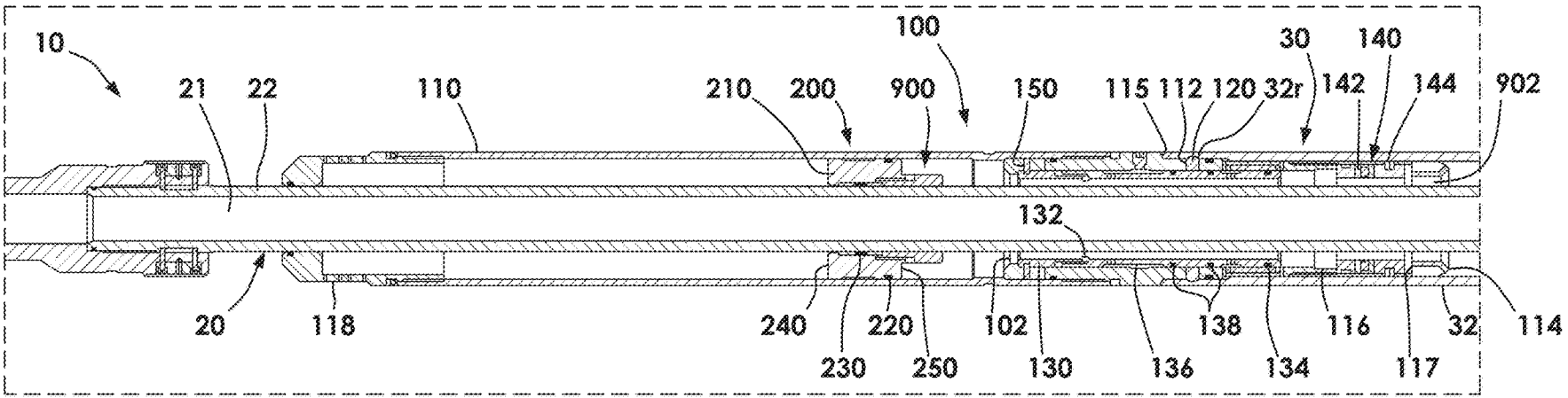
FIG. 2 illustrates the portion of the liner string within the circled region in FIG. 1 labeled FIG. 2.

The connector 100 and bonnet 200 are illustrated in FIG. 2. FIG. 2 refers to the circled region in FIG. 1. The connector 100 releasably attaches the LHDA 20 to the upper end of the PBR 32. The connector 100 may include a tubular body 110, a latch 120, a sleeve 130, a thrust bearing assembly 140, and one or more shearable members 150. The tubular body 110 may be one integral component, or it may be formed from multiple sections. The tubular body 110 defines a bore 102, and the first tubular 22 is disposed in the bore 102. The tubular body 110 has one or more openings 112, a first shoulder 114, a second shoulder 115, a groove 116, a third shoulder 117, and one or more vents 118. The second shoulder 115 abuts the end of the PBR 32. The one or more vents 118 allow fluid communication between the wellbore fluids and the bore 102 above the bonnet 200.

Figures 8A, 8B, 8C, 8D, 9, 9A, 9B, 9C, 9D, 10, 11, 12, 13, 13A, 13B, 13C, 13D:
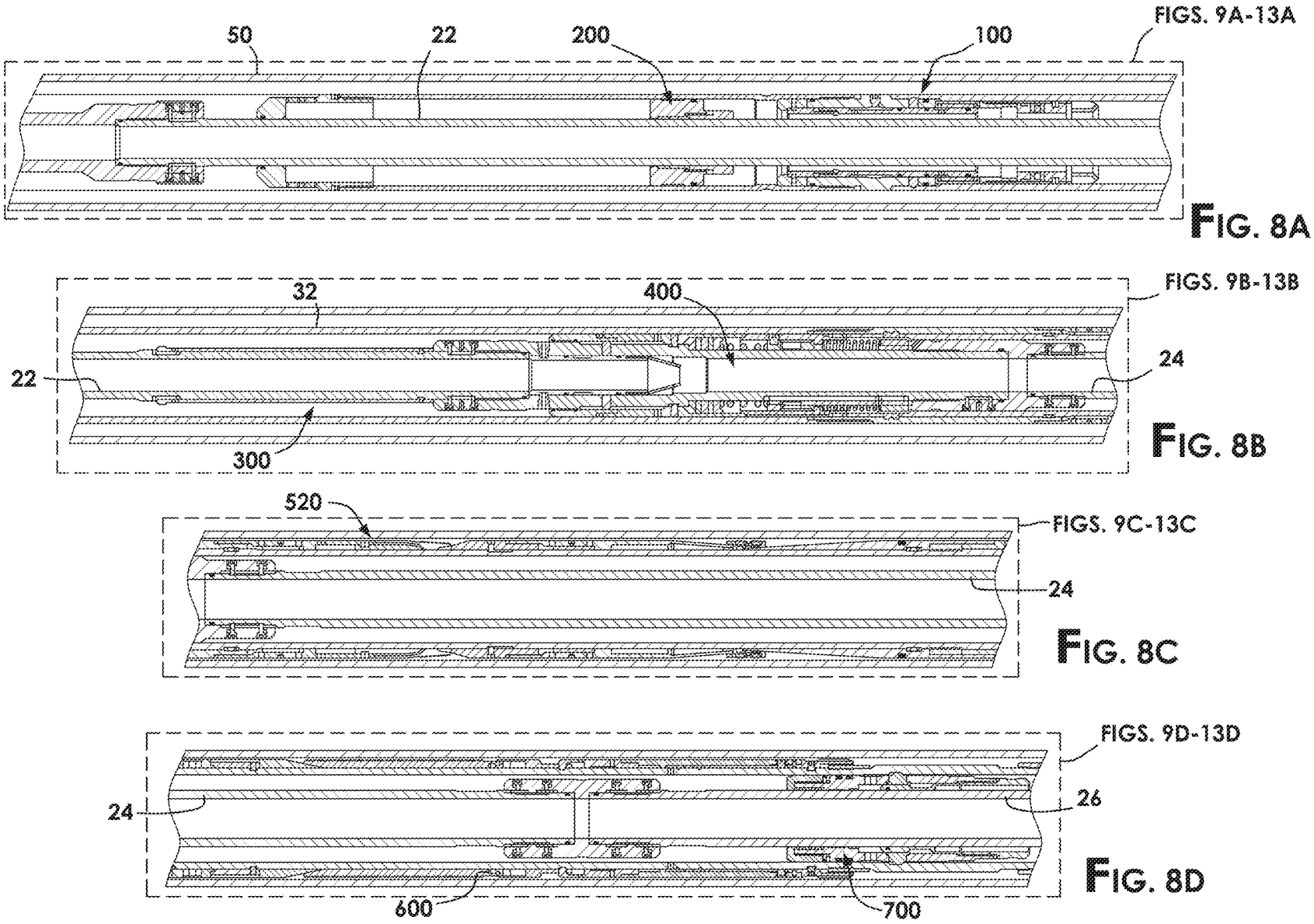
Figure 9A:
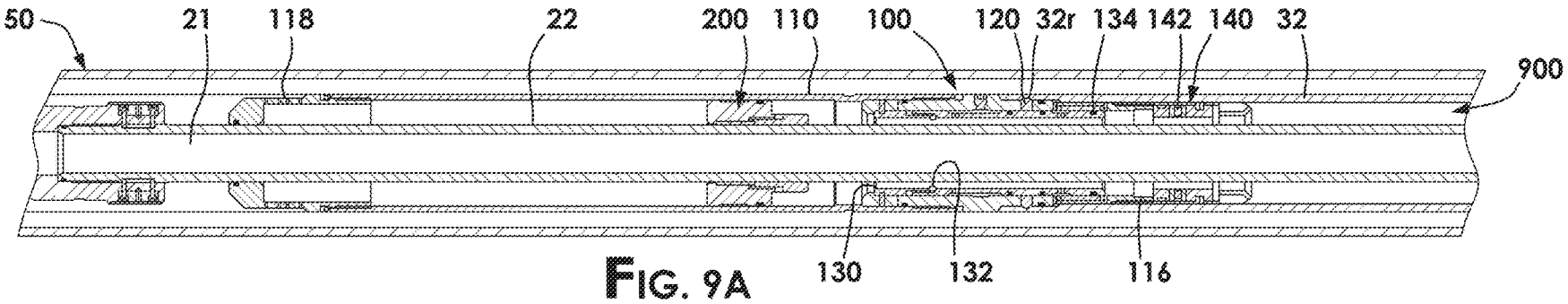

The thrust bearing assembly 140 includes a thrust bearing 142. The thrust bearing assembly 140 is releasably attached to the tubular body 110 in a first position by one or more shearable members 144. The thrust bearing assembly 140 is movable to a second position, as shown in FIG. 13A, where it is engaged with the third shoulder 117. The thrust bearing 142 is movable to the second position after the shearable members 144 are sheared in response to force applied to the sleeve 130 by the packer actuator 300. When the thrust bearing assembly 140 is in the second position, the thrust bearing assembly 140 facilitates rotation of the LHDA 20 relative to the LHA 30 while the packer 500 is actuated.

The latch 120 may be one or more dogs. The dogs 120 are disposed in a corresponding opening 112 as shown in FIG. 2. Each dog 120 is partially disposed in both the opening 112 and a corresponding recess 32r in the PBR 32 when in a radially extended position. When the dogs 120 are in the radially extended position, the connector 100, and thus the LHDA 20, is attached to the PBR 32. The dogs 120 are moveable to a radially retracted position, as shown in FIG. 13A, to release the connector 100, and thus the LHDA 20, from the PBR 32.

The sleeve 130 is disposed in the bore 102 and is maintained in a first position by the one or more shearable members 150. The sleeve 130 may include a first snap ring 132, a second snap ring 134, a recess 136, and seals 138. In the first position, the sleeve 130 maintains the dogs 120 in the radially extended position, and the seals 138 straddle the openings 112 to prevent fluid communication between the bore 102 and the openings 112. When the sleeve 130 is in the second position, as shown in FIG. 13A, the recess 136 is positioned adjacent the dogs 120 to allow the dogs 120 to release from the PBR 32. Also, the snap ring 134 has expanded into the groove 116 to prevent the sleeve 130 from moving back into the first position. As the sleeve 130 moves to the second position, the sleeve 130 engages the thrust bearing assembly 140 with sufficient force to shear the one or more shearable members 144. When the sleeve 130 is in the second position, the thrust bearing assembly 140 is in the second position.

The bonnet 200 is disposed in the bore 102 of the connector 100. The bonnet 200 may include a body 210, an outer seal 220, and an inner seal 230. The outer seal 220 seals against the inner surface of the tubular body 110. The inner seal 230 seals against the outer surface of the first tubular 22. The bonnet 200 is movable relative to the first tubular 22 and the connector 100. The bonnet 200 has an upper piston area 240 and a lower piston area 250. The upper piston area 240 is in fluid communication with the wellbore fluids via the vents 118. The lower piston area 250 is in fluid communication with the chamber 900.

Figure 3A:
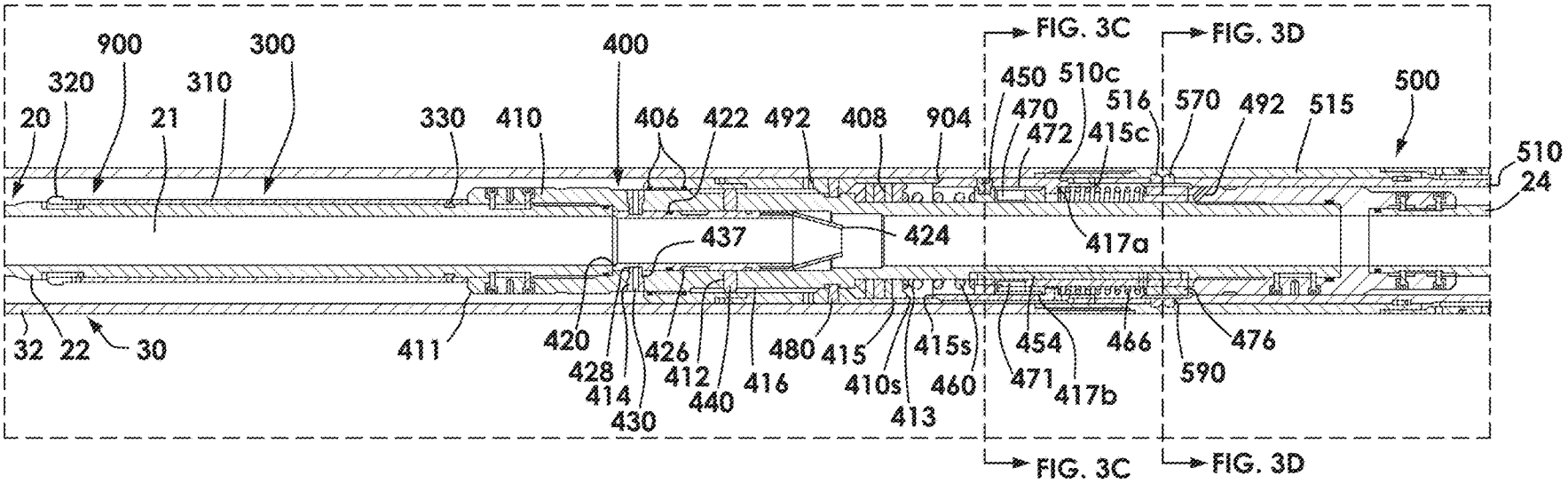
FIG. 3A illustrates the portion of the liner string within the circled region in FIG. 1 labeled FIG. 3A.

FIG. 3A illustrates an exemplary embodiment of the packer actuator 300 and the running tool 400. An upper end of the packer 500 is also shown in FIG. 3A. The packer actuator 300 may include a tubular body 310 with a catch shoulder 320 disposed at one end. The packer actuator 300 may be attached to the first tubular 22, such as by fasteners 330. In some embodiments, the packer actuator 300 is integral with the running tool 400. The packer actuator 300 is configured to engage the sleeve 130 when the LHDA 20 is lifted relative to the LHA 30. The catch shoulder 320 is configured to engage the first snap ring 132. Once the catch shoulder 320 has engaged the first snap ring 132, force (e.g., weight) may be applied to the LHDA 20 to cause the sleeve 130 to move to the second position. The force is transferred from the second shoulder 115 to the PBR 32, which facilitates actuating the packer 500. The packer 500, and the actuation thereof, will be described in greater detail below.

An exemplary embodiment of the running tool 400 is shown in FIG. 3A. The running tool 400 is shown in the locked position. The running tool 400 may include a thrust bearing 408, a tubular body 410, a body sleeve 415, a seat sleeve 420, one or more shearable plugs 430, one or more dogs 440, a keyway ring 450, a plurality of keys 454, a first biasing member 460, a second biasing member 466, a first nut 470, and a second nut 476. The tubular body 410 may be one integral component, or it may be composed of multiple sections. The tubular body 410 defines a bore 402. The central bore 21 includes the bore 402. The tubular body 410 has a stop surface 411, one or more openings 412, one or more ports 414, a first shoulder 410*s*, and a second shoulder 413. The body sleeve 415 is disposed about the tubular body 410. The body sleeve 415 may include a shear ring 416, a first shoulder 415*s*, a second shoulder 417*a*, a third shoulder 417*b*, a plurality of castellations 415*c*, and threads 472. The body sleeve 415 may be one integral component, or it may be composed of multiple sections. One or more shearable members 480 may releasably attach the tubular body 410 to the body sleeve 415. The castellations 415*c* correspond to the castellations 510*c* of the packer 500. The tubular body 410 and body sleeve 415 may also include one or more flow ports 492. An annulus 904 is between the running tool 400 and the PBR 32 and between the running tool 400 and the tubular mandrel 510 of the packer 500.

A seat sleeve 420 is disposed in the bore 402. The seat sleeve 420 may include a seat 424, a recess 426, and one or more retainers 428. The seat sleeve 420 is maintained in a closed position by the one or more shearable plugs 430. The shearable plugs 430 are partially disposed in a corresponding port 414 and retainer 428. One or more seals 422 may be disposed between the seat sleeve 420 and the tubular body 410. In some embodiments, the seals 422 have the same diameter, such that the seat sleeve 420 is pressure balanced. As shown in FIG. 3A, the dogs 440 are in the radially extended position when the seat sleeve 420 is in the closed position. As shown in FIG. 11B, when the seat sleeve 420 is in the open position the recess 426 is positioned such that the dogs 440 are allowed to retract to a radially retracted position.

Figure 3C:
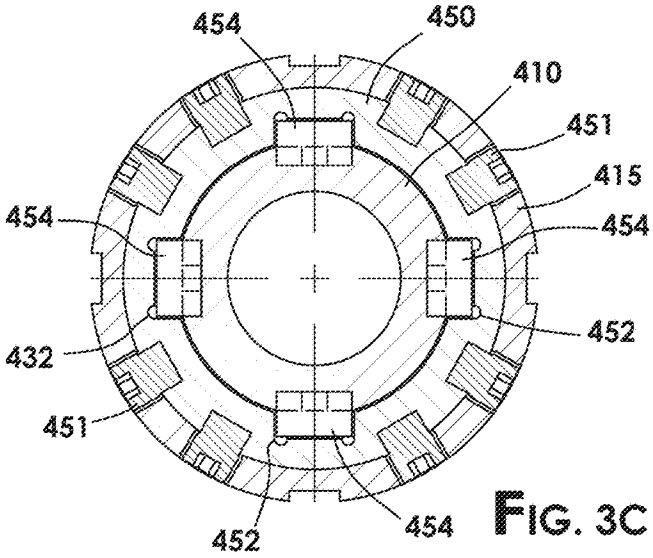
FIG. 3C illustrates a cross section of the running tool about the plane C-C in FIG. 3A.
Figure 3D:
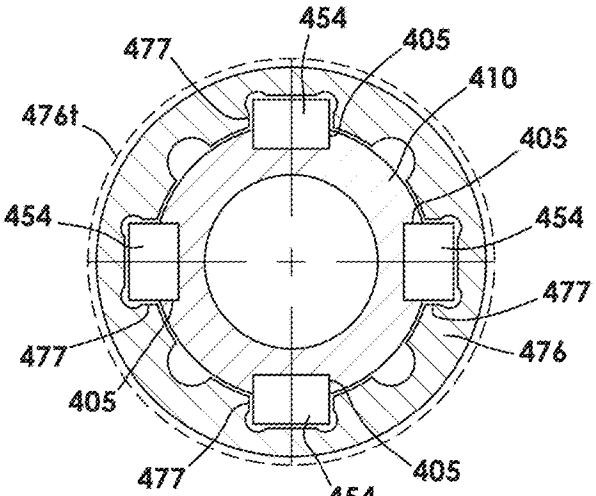
FIG. 3D illustrates a cross section of the running tool about the plane D-D in FIG. 3A.
Figure 3B:
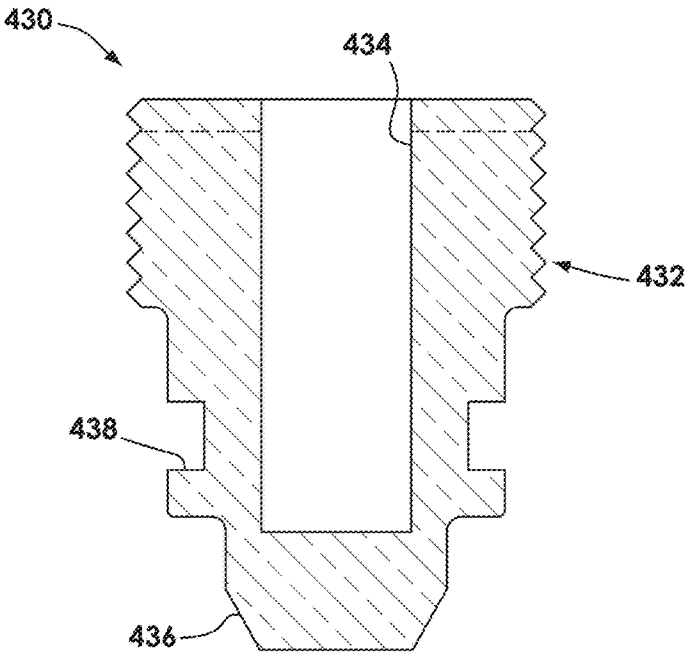
FIG. 3B illustrates a cross section of a shearable plug.

A cross section of the shearable plug 430 is shown in FIG. 3B. The shearable plugs 430 may have threads 432, a flow bore 434, and a closure member 436, and a groove 438. The threads 432 correspond to threads of the corresponding port 414. Each shearable plug 430 is partially disposed in the one or more ports 414 and the retainer 428 to lock the seat sleeve 420 in the closed position. The closure member 436 is at least partially disposed in the retainer 428. In one example, the retainer 428 may have threads for mating with threads located about the closure member 436 of the shearable plug 430. Before the seat sleeve 420 is actuated to move from the closed position to the open position, fluid communication between the central bore 21 and the chamber 900 is blocked by the shearable plug 430. The one or more shearable plugs 430 is configured to fail along a shear plane in response to sufficient applied pressure to shear off a portion of the shearable plug 430 to open the flow bore 434. The portion of the shearable plug 430 sheared off includes the closure member 436. As shown in FIG. 3B, the closure member 436 is a cap. An 0-ring 437 may be placed in the groove 438 to seal against the inner surface of the port 414. The closure member 436 can be sheared off by the seat sleeve 420 when the seat sleeve 420 is actuated to move from the closed position to the open position. In some embodiments the retainer 428 is configured to retain the sheared off portion of the shearable plug 430, such as the cap 436, to prevent the sheared off portion from falling downhole. Once the flow bore 434 is opened, a flow path is present between the central bore 21 and the chamber 900.

In some embodiments, the ports 414 are not threaded, and the shearable plugs 430 do not have threads 432 and are instead fastened into the ports 414 with one or more fasteners, such as bolts. In some embodiments, the shearable plug 430 is made of metal. For example, the shearable plug 430 may be brass. In some embodiments, the shearable plug 430 may be formed from a plastic.

FIG. 3C is a cross section of the running tool 400 about plane C-C in FIG. 3A, and the PBR 32 is now shown. As shown in FIG. 3C, the keyway ring 450 includes keyways 452 for receiving keys 454. The keyway ring 450 may be attached to or integral with the body sleeve 415. As shown, the keyway ring 450 is fastened to the body sleeve 415 by a plurality of fasteners 451. Each key 454 is coupled to the tubular body 410 and is disposed in a respective keyway 452 when the running tool 400 is in the locked position. In addition to being disposed in the keyways 452, the keys 454 are partially disposed in keyways 405 formed in the tubular body 410. The tubular body 410 is torsionally locked with the body sleeve 415 via the keyway ring 450 when the keys 454 are disposed in the keyways 452.

Referring to FIG. 3A, the first nut 470 has outer threads and is threadedly coupled to the threads 472 of the body sleeve 415. The first nut 470 is configured to travel along the threads 472 from a first position to a second position (FIG. 11B) in response to the rotation of the running tool 400 relative to the LHA 30. The second nut 476 has outer threads 476t and is threadedly coupled to the tubular mandrel 510 via threads 590 formed on the surface of the tubular mandrel 510. The second nut 476 is configured to travel along the threads 590 from a first position to a second position (FIG. 11B) in response to the rotation of the running tool 400 relative to the LHA 30. The first biasing member 460, such as a spring, is disposed between the second shoulder 413 and the keyway ring 450. The second biasing member 466, such as a spring, is disposed between the second shoulder 417*a* and the second nut 476. The first and second biasing members 460, 466 bias the running tool 400 in the locked position. As shown in FIG. 3A, the second nut 476 maintains the latch mechanism 570 of the packer 500 in a radially extended position.

In one embodiment, the threads of the first nut 470 and the threads 472 may have a finer pitch, be greater in number, and run in an opposite rotational direction than the threads of the second nut 476 and the threads 590. The difference in pitch allows greater axial displacement of the second nut 476 as compared to the first nut 470 per rotation. Thus, the second nut 476 may be disengaged from the threads 590 before the first nut 470 engages the third shoulder 417*b*.

The first nut 470 has keyways 471 for receiving keys 454. FIG. 3D is a cross section of the running tool 400 about plane D-D in FIG. 3A; and the packer 500 is not shown in the cross-section about plane D-D. As shown in FIG. 3D, the second nut 476 has keyways 477 for receiving to the keys 454. The first and second nuts 470, 476 are axially moveable relative to the tubular body 410 from their respective first positions to their respective second positions along the keys 454. The keys 454 may move relative to the first and second nuts 470, 476 in their respective keyways 471, 477. The keys 454 transfer torque from the tubular body 410 to the first and second nuts 470, 476 to facilitate their rotation relative to the tubular body 410. The keys 454 and the first nut 470 comprise a lock assembly to transmit torque from the tubular body 410 to the body sleeve 415 once the first nut 470 engages the third shoulder 417*b*. However, the running tool 400 may be withdrawn from the LHA 30 when the first nut 470 is in the second position.

The running tool 400 is movable from the locked position to an unlocked position. When in the unlocked position, the running tool 400 is released from the LHA 30, such as being released from the packer 500. To unlock the running tool 400, force is applied to the tubular body 410 to shear the one or more shearable members 480. Once the shearable members 480 are sheared, the tubular body 410 moves axially relative to the body sleeve 415, compressing the first biasing member 460. The tubular body 410 moves axially relative to the body sleeve 415 until the first shoulder 410*s* engages the first shoulder 415*s*. The axial movement of the tubular body 410 relative to the body sleeve 415 withdraws the keys 454 from the keyways 452 and moves the flow bore 434 of the shearable plug 430 between the two seals 406. Once the keys 454 are withdrawn from the keyways 452, the tubular body 410 is no longer torsionally locked to the body sleeve 415, allowing the tubular body 410 to be rotated relative to the body sleeve 415 and the LHA 30. The body sleeve 415 is not rotatable with the tubular body 410 due to the engagement of the castellations 415*c*, 510*c*. During the rotation of the tubular body 410, the first nut 470 advances along the threads 472 from the first position to the second position. In the second position, the first nut 470 is engaged with the third shoulder 417*b* as shown in FIG. 11B. During rotation of the tubular body 410, the second nut 476 advances along the threads 590 from the first position to the second position. The movement of the second nut 476 compresses the second biasing member 466. In the second position, the second nut 476 is no longer threaded to the tubular mandrel 510 via threads 590 and no longer maintains the latch mechanism 570 in the radially extended position. Once the second nut 476 is in the second position, the running tool 400 is in the unlocked position.

As shown in FIG. 3A, the dogs 440 are engaged with the shear ring 416 when in the radially extended position. The shear ring 416 and dogs 440 aid in preventing the unintentional shearing of the one or more shearable members 480 and/or withdrawal of the keys 454 from the keyways 452. During run-in, the LHA 30 may briefly become engaged with a casing or wellbore wall, such that application of additional force to the LHDA 20 may be required to continue the downhole movement of the liner string 10. The additional force exerted on the LHDA 20 may exceed the shear strength of the shearable members 480 and the biasing force of the first biasing member 460. In one embodiment, the dogs 440 prevent premature shearing of the shearable members 480. The engagement of the dogs 440 with the shear ring 416 allows the force to transfer from the tubular body 410 to the body sleeve 415, which then transfers the force to the LHA 30 via the engaged castellations 415*c*, 510*c* and the latch mechanism 570. When the seat sleeve 420 is in the second position, the dogs 440 are allowed to disengage from the shear ring 416, allowing force applied to the LHDA 20 to shear the one or more shearable members 480 and to overcome the biasing force of the first biasing member 460 to withdraw the keys 454.

Figure 4:
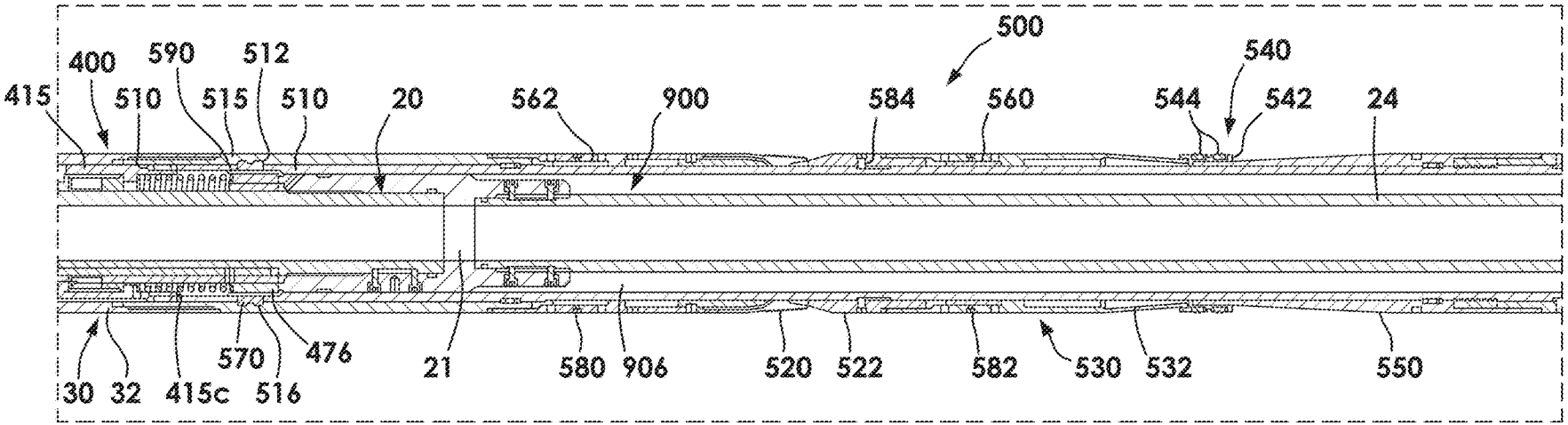
FIG. 4 illustrates the portion of the liner string within the circled region in FIG. 1 labeled FIG. 4.

An exemplary packer 500 in an unset position is illustrated in FIG. 4. In this example, the packer 500 is mechanically actuated. The packer 500 may include the tubular mandrel 510, an outer sleeve 515, a plurality of slips 520, a gauge ring 522, a retaining sleeve 530, a packing element 540, an expansion cone 550, a first locking mechanism 560, a second locking mechanism 562, and a latch mechanism 570. The tubular mandrel 510 may include one or more openings 512 and a plurality of castellations 510*c* at one end that correspond to the castellations 415*c*. The tubular mandrel 510 may be one integral component, or it may be made out of multiple sections. The tubular mandrel 510 includes threads 590 corresponding to the second nut 476. The gauge ring 522 and expansion cone 550 are coupled to the tubular mandrel 510. The tubular mandrel 510 is disposed in the outer sleeve 515. The outer sleeve 515 may be one integral component, or it may be made out of multiple sections. The outer sleeve 515 includes a profile 516 for receiving the latch mechanism 570. The outer sleeve 515 may be threadedly engaged with the PBR 32 at one end.

The retaining sleeve 530 is disposed about the tubular mandrel 510. The retaining sleeve 530 may be retained in a first position by one or more shearable members 582. The retaining sleeve 530 includes a plurality of collet fingers 532 at one end. The packing element 540 is coupled to the retaining sleeve 530 via the collet fingers 532. The packing element 540 has a body 542 and one or more seals 544. The packing element 540 is configured travel along the expansion cone 550 to expand from a radially retracted position (FIG. 4) to a radially expanded position (FIG. 13C) in response to the mechanical actuation force. When the packing element 540 is in the radially expanded position, it is configured to sealingly engage the inner surface of a casing or wellbore that the liner string 10 is disposed within. The first locking mechanism 560 is configured to prevent the retaining sleeve 530, and thus the packing element 540, from travelling back down the expansion cone 550 once the packing element 540 has been expanded. The first locking mechanism 560 may be a ratchet surface engaged with the tubular mandrel 510.

The slips 520 are disposed at one end of the outer sleeve 515. The outer sleeve 515 may be initially retained in a first position by one or more shearable members 580. As shown in FIG. 4, the slips 520 are shown in the radially retracted position. The slips 520 are configured to travel along the gauge ring 522 to move from the radially retracted position to a radially extended position, as shown in FIG. 13C, in response to the mechanical actuation force. The second locking mechanism 562 is configured to prevent the outer sleeve 515, and thus the slips 520, from travelling back down the gauge ring 522 once the slips 520 are in the radially extended position. The second locking mechanism 562 may be a ratchet surface engaged with the tubular mandrel 510. The outer sleeve 515 and/or slips 520 are configured to apply a force to the gauge ring 522 sufficient to shear the shearable members 582 and to move the retaining sleeve 530 to the second position to radially expand the packing element 540 before the slips 520 travel along the gauge ring 522 into the radially extended position.

The latch mechanism 570 is configured to axially and torsionally lock the outer sleeve 515 and tubular mandrel 510 together when in the radially extended position. The latch mechanism 570 may be one or more dogs disposed in the openings 512. The latch mechanism 570 is configured to engage the profile 516 of the tubular mandrel 510. The latch mechanism 570 is maintained in the radially extended position, and thus in engagement with the profile 516, by the second nut 476. When the running tool 400 is moved to the unlocked position, the second nut 476 no longer prevents the latch mechanism 570 from disengaging the profile 516, thereby allowing the latch mechanism 570 to move to a radially retracted position.

To actuate the packer 500, the LHDA 20 is lifted to engage the packer actuator 300 with the sleeve 130. When force (e.g., weight) is applied to the LHDA 20, the sleeve 130 moves to the second position, releasing the latch 120 and transferring force from the second shoulder 115 to the upper end of the PBR 32. The force exerted on the PBR 32 is transferred to the outer sleeve 515. After the shearable members 580 shear, the outer sleeve 515 moves relative to the tubular mandrel 510. The outer sleeve 515 and/or slips 520 engage the gauge ring 522 and cause the shearable members 584 to shear to allow the gauge ring 522 to move relative to the tubular mandrel 510. Once the shearable members 584 shear, the actuation force causes the retaining sleeve 530 to shear the shearable members 582 to allow the retaining sleeve 530 to move relative to the tubular mandrel 510. The outer sleeve 515, the slips 520, the gauge ring 522, and the retaining sleeve 530 move relative to the tubular mandrel 510 to urge the packing element 540 along the expansion cone 550 until the packing element 540 is in the radially expanded position. Once the packing element 540 is in the radially expanded position, the force applied to the outer sleeve 515 causes the slips 520 to travel along the gauge ring 522 to engage the inner surface of the casing or wellbore. Once the slips 520 engage the wellbore or casing, the packer 500 is in a set position as shown in FIG. 13C.

Figure 5:
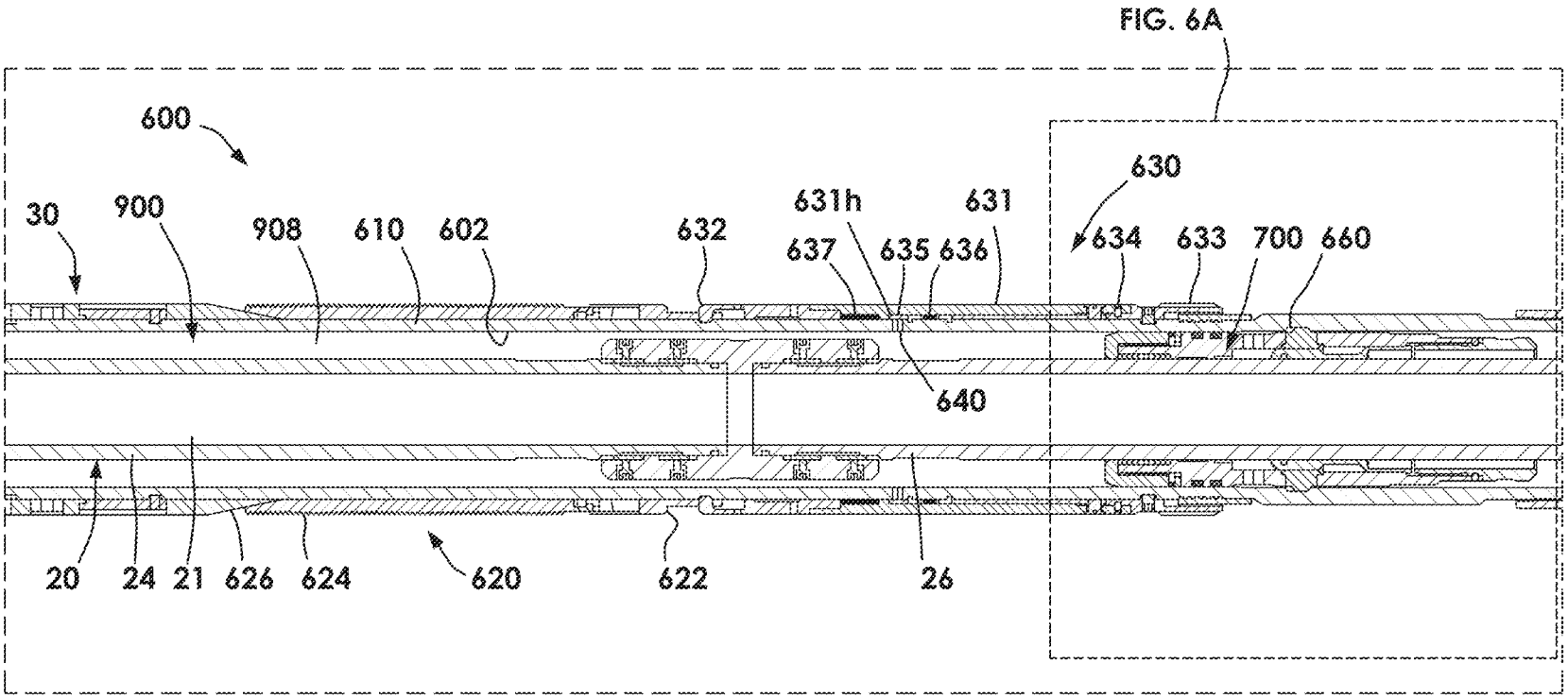
FIG. 5 illustrates the portion of the liner string within the circled region in FIG. 1 labeled FIG. 5.

FIG. 5 illustrates an exemplary liner hanger 600 in an unset position. The liner hanger 600 may include a tubular mandrel 610, a slip assembly 620, and a slip actuation assembly 630. The tubular mandrel 610 defines a central bore 602 of the liner hanger 600 and includes a port 640 and one or more recesses 660. The liner hanger 600 can have more than one port 640. The slip assembly 620 may include a first abutment member 622 and a plurality of slips 624 configured to ride up one or more ramps 626 coupled to the tubular mandrel 610. The slip actuation assembly 630 may include a piston member 631, a second abutment member 632, a sleeve member 633, one or more shearable members 634, and a piston chamber 635 disposed between a first seal 636 and a second seal 637.

The sleeve member 633 is attached to the tubular mandrel 610, such as by a plurality of fasteners. The piston member 631 is attached to the second abutment member 632 at one end. The second seal 637 is coupled to the piston member 631. The piston member 631 is releasably attached to the sleeve member 633 via the one or more shearable members 634. In some embodiments, the one or more shearable plugs 430 may be configured to shear at a lower pressure than the pressure necessary to shear the one or more shearable members 634. The first seal 636 is disposed between the tubular mandrel 610 and the piston member 631, and the first seal 636 is affixed to the tubular mandrel 610. The piston chamber 635 is in fluid communication with the port 640.

In order to set the slips 624, pressure is increased in the piston chamber 635 until the force acting on the piston head 631h of the piston member 631 is sufficient to shear the one or more shearable members 634. Then, the piston member 631, the second seal 637, and the second abutment member 632 move, in response to the fluid in piston chamber 635, relative to the tubular mandrel 610 until the second abutment member 632 engages the first abutment member 622. Once engaged, the first abutment member 622 moves in response to the continued movement of the second abutment member 632 and piston member 631 until the slips 624 ride up the ramps 626 into engagement with a casing or an inner surface of the wellbore. In some embodiments, the pressure needed to shear the one or more shearable members 634 is equivalent to the pressure to shear the shearable plugs 430. The liner hanger 600 is shown in a set position in FIG. 10D.

Figure 6A:
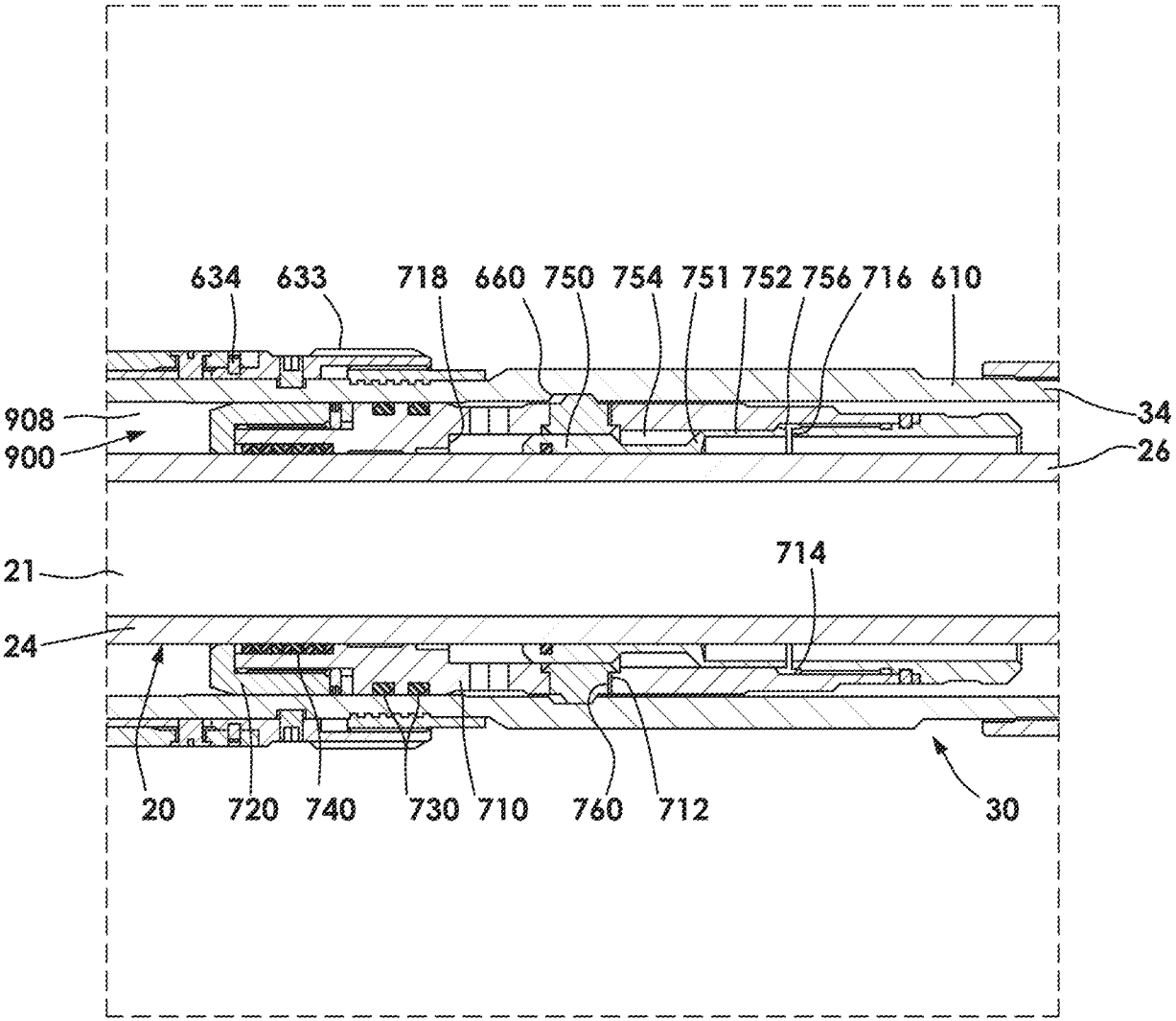
FIG. 6A-6B illustrate the packoff.
Figure 6B:
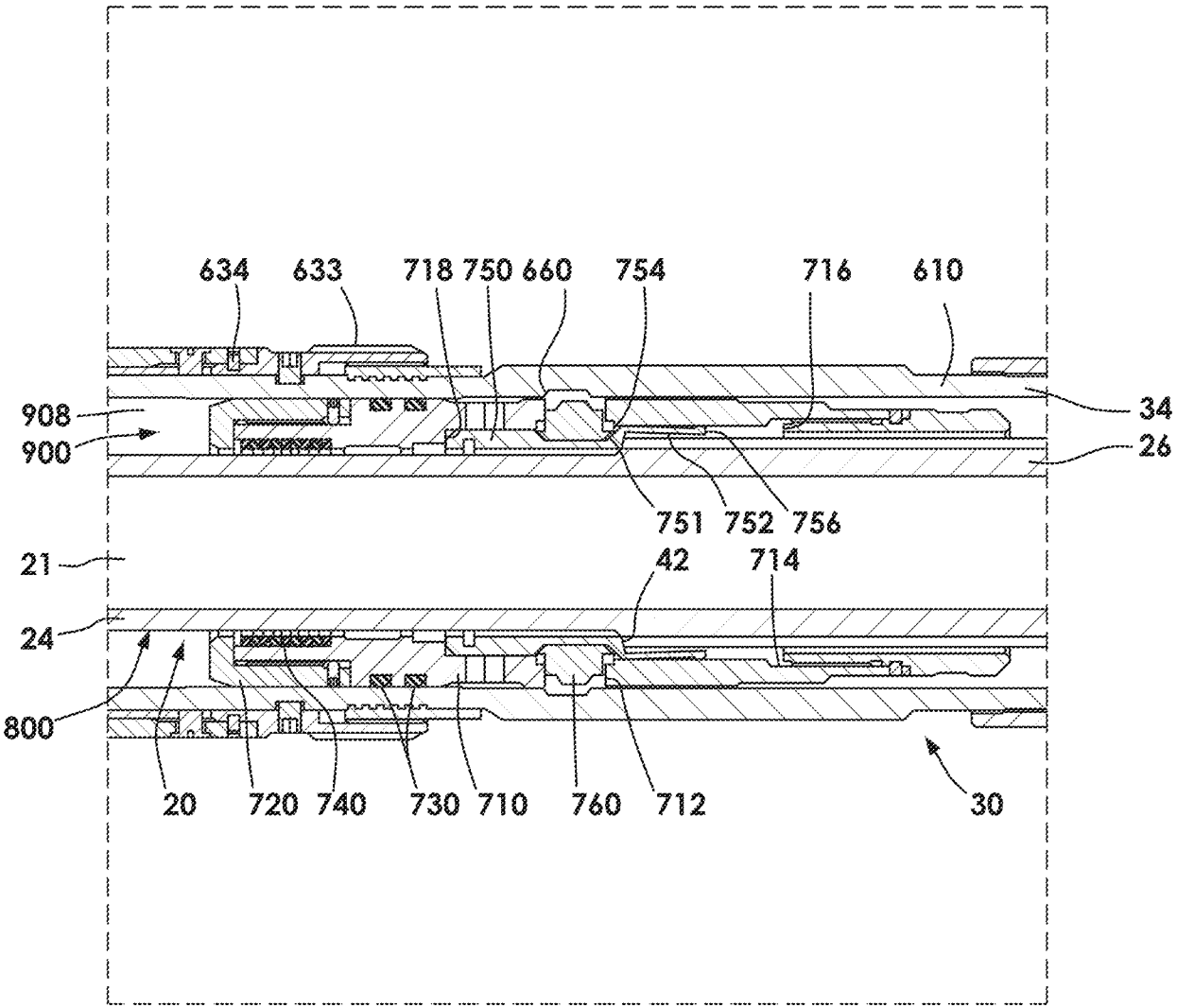

FIG. 6A-6B illustrates an exemplary embodiment of the packoff 700. FIG. 6A illustrates the packoff 700 in an engaged position. FIG. 6B illustrates the packoff 700 in the disengaged position. The packoff 700 includes a body 710, a cap 720, seals 730, a seal stack 740, a lock sleeve 750, and one or more dogs 760. The seals 730 are disposed about the body 710 and are configured to engage with the inner surface of the tubular mandrel 610. The seal stack 740 is configured to seal against the outer surface of the third tubular 26. The body 710 includes openings 712, a groove 714, a shoulder 716, and a stop shoulder 718. Each dog 760 is disposed in a corresponding opening 712. As shown in FIG. 6A, the chamber 900 is bounded at a lower end by the seals 730 and seal stack 740.

The lock sleeve 750 may include a taper 751, a plurality of collet fingers 752, and a groove 754. The taper 751 is formed in a wall of the lock sleeve 750. The collet fingers 752 extend from the taper 751 to a lower end of the lock sleeve 750. The collet fingers 752 have lugs 756 configured to engage the groove 714 when the lock sleeve 750 is in a lock position. The collet fingers 752 may be cantilevered from the taper 751 and have a stiffness urging the lugs 756 into engagement with the groove 714. The lock sleeve 750 is axially movable relative to the body 710. The lock sleeve 750 is maintained in the lock position by the engagement of the lugs 756 in the groove 714 and the engagement of the lugs 756 with the shoulder 716.

As shown in FIG. 6A, the dogs 760 are in a radially extended position when the packoff 700 is in the engaged position. The dogs 760 are maintained in the radially extended position by the lock sleeve 750 when the lock sleeve 750 is in the lock position. When the dogs 760 are in the radially extended position, the dogs 760 are partially disposed in the corresponding recess 660 of the tubular mandrel 610. The lock sleeve 750 is movable from the lock position to an unlocked position FIG. 6B to allow the dogs 760 to move from the radially extended position to the radially retracted position. A catch shoulder 42 is configured to abut the lock sleeve 750 as the LHDA 20 is withdrawn from the LHA 30. The lock sleeve 750 is moved from the lock position to the unlocked position when engaged with the catch shoulder 42 upon retrieval of the LHDA 20. For example, the engagement of a catch shoulder 42 with the lock sleeve 750 urges the lugs 756 from the groove 714, allowing the lock sleeve 750 to move axially relative to the body 710 until it engages the stop shoulder 718. When the lock sleeve 750 has engaged the stop shoulder 718, it is in the unlocked position. When the lock sleeve 750 is in the unlocked position, the dogs 760 are allowed to move to the radially retracted position. When the dogs 760 are in the radially retracted position, the packoff 700 is in the disengaged position. When the packoff 700 is in the disengaged position, the packoff can be retrieved from the tubular mandrel 610 of the liner hanger 600. The catch shoulder 42 may be attached to or integral with the third tubular 26. For example, the catch shoulder 42 may be the end of a sleeve attached to the third tubular 26. In some embodiments, the catch shoulder 42 is integral with or attached to the plug assembly 40. In some embodiments, the catch shoulder 42 is a portion of the plug assembly 40.

Figure 7:
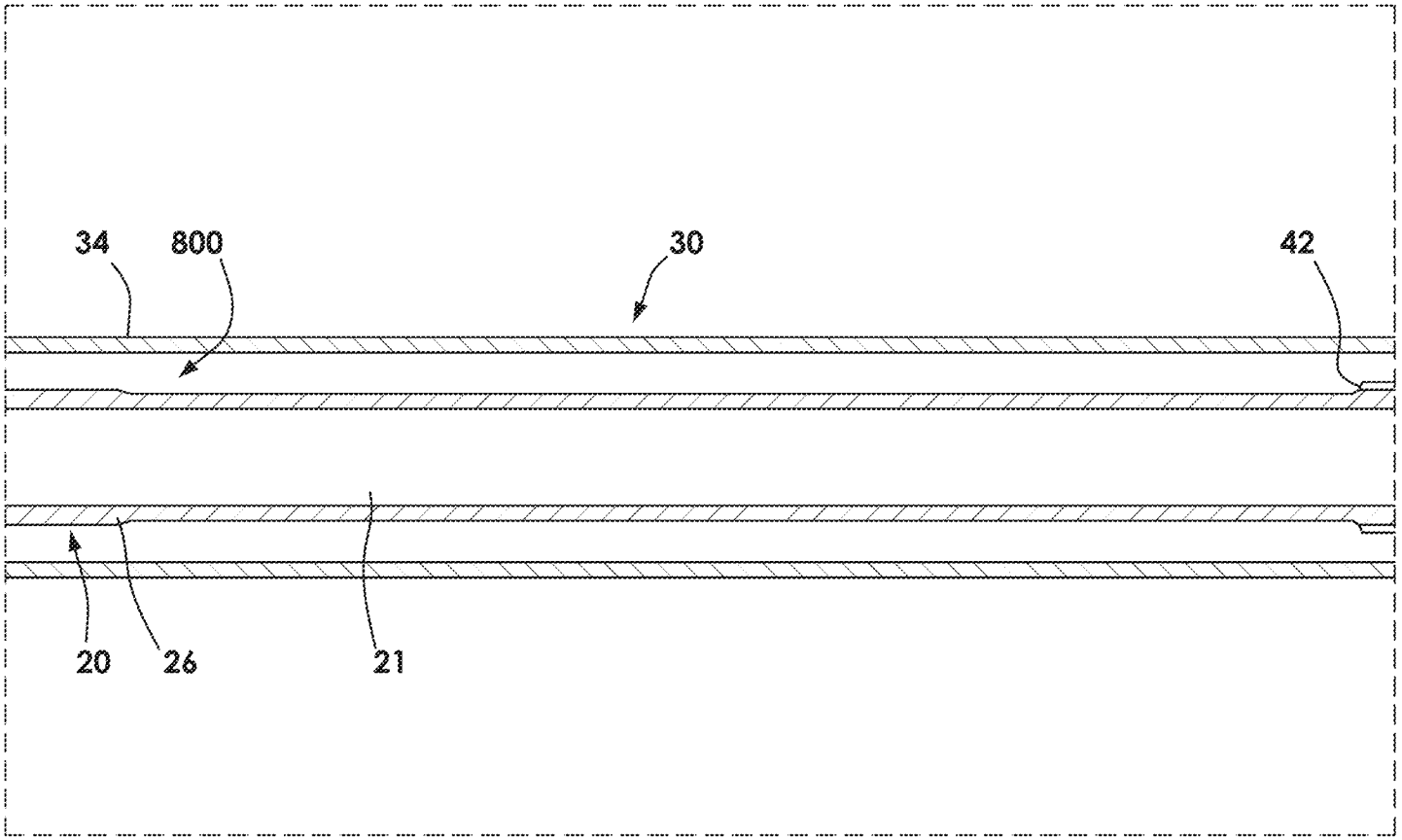
FIG. 7 illustrates the portion of the liner string within the circled region in FIG. 1 labeled FIG. 7.

FIG. 7 illustrates an exemplary embodiment of the seal bypass 800. As shown in FIGS. 1 and 7, the seal bypass 800 is positioned downhole of the packoff 700. When the LHDA 20 is lifted relative to the LHA 30 to engage the packer actuator 300 with the sleeve 130, the seal bypass 800 is positioned adjacent the seal stack 740 of the packoff 700. When the seal bypass 800 is positioned adjacent the seal stack 740, the seal stack 740 cannot seal against the outer surface of the third tubular 26. Thus, the seal bypass 800 allows fluid communication around the seal stack 740 when positioned adjacent the seal stack 740. The chamber 900 is not isolated from the wellbore fluids when the seal bypass 800 is positioned adjacent the seal stack 740.

The seal bypass 800 may be one or more longitudinally running grooves formed in the third tubular 26. The one or more grooves have a sufficient length and depth to prevent the seal stack 740 from sealing against the third tubular 26 when positioned adjacent the seal stack 740. The seal bypass 800 may alternatively be one or more flow paths disposed in the wall of the third tubular 26, such that both openings of an individual flow path straddle the seal stack 740 when the seal bypass 800 is positioned adjacent the seal stack 740.

The seal bypass 800 is positioned adjacent the seal stack 740 when the LHDA 20 is raised to engage the packer actuator 300 with the sleeve 130. The seal bypass 800 is also positioned adjacent the seal stack 740 as the LHDA 20 is raised to move the lock sleeve 750 to the unlocked position.

The chamber 900 is illustrated in FIGS. 1-7. The chamber 900 is a portion of an annulus between the LHDA 20 and the LHA 30. As shown in FIG. 2, the upper end of the chamber 900 is bounded by the engagement of the outer seal 220 with the tubular body 110 and the engagement of the inner seal 230 with the first tubular 22. As shown in FIG. 6A, the lower end of the chamber 900 is bounded by the engagement of the seals 730 with the inner surface of the tubular mandrel 610 and the engagement of the seal stack 740 with the outer surface of the third tubular 26. Additional seals between interconnecting components of the LHDA 20 and the LHA 30 prevent fluid communication between the chamber 900 and either the outer annulus of the liner string 10 and the central bore 21 of the LHDA 20.

As shown in FIG. 2, the chamber 900 includes an annulus 902 that is between the connector 100 and the first tubular 22 and between the PBR 32 and the first tubular 22. As shown in FIG. 3A, the chamber 900 includes the annulus 904. The flow ports 492 facilitate fluid communication between the portion of the chamber 900 above the running tool 400 and the portion of the chamber 900 below the running tool 400. As shown in FIG. 4, the chamber includes an annulus 906 between the packer 500 and the second tubular 24. As shown in FIG. 5, the chamber 900 includes an annulus 908 between the tubulars 24, 26 and the liner hanger 600.

The chamber 900 may be filled with a fluid at a selected pressure, such as water at atmospheric pressure. The bonnet 200 is movable relative to the connector 100 and floats on fluid in the chamber 900. The bonnet 200 can move uphole or downhole in response to volumetric changes of the fluid in the chamber 900 due to environmental thermal effects and/or hydrostatic effects of the wellbore fluids acting on the piston areas 240, 250 of the bonnet 200. The fluid pressure in the chamber 900 is equalized with the wellbore fluid pressure because the bonnet 200 floats on the fluid in the chamber 900 and is movable in response to forces acting on the piston areas 240, 250. The equalized pressure in the chamber 900 prevents a collapse of the LHA 30 due to the pressure of the wellbore fluids.

During run-in, the chamber 900 is isolated from the outer annulus of the liner string 10 and the central bore 21 of the LHDA 20 to prevent inadvertent actuation of the liner hanger 600. In order to actuate the liner hanger 600, the running tool 400 is actuated to allow fluid communication between the central bore 21 and the chamber 900 by shearing the shearable plugs 430 to expose the flow bore 434. When the running tool 400 is released from the packer 500, the tubular body 410 has moved relative to the body sleeve 415 such that the flow bore 434 is bounded by the seals 406. Thus, the chamber 900 is re-isolated from the central bore 21. When the LHDA 20 is lifted relative to the LHA 30 to engage the packer actuator 300 with the sleeve 130, the seal bypass 800 is moved uphole and is positioned adjacent the seal stack 740 to establish fluid communication between the chamber 900 and the wellbore fluids to facilitate the actuation of the packer 500.

FIG. 8 illustrates an exemplary liner string 10 disposed in a casing 50. As shown in FIG. 8, several regions of the liner string 10 labeled FIGS. 9A-13A, 9B-13B, 9C-13C, and 9D-13D. These regions will be discussed below to illustrate an exemplary operation sequence of the liner string 10.

FIGS. 9A, 9B, 9C, and 9D, illustrate the liner string 10 after run-in to the setting depth in the casing 50. FIG. 9A illustrates the connector 100 and bonnet 200. The connector 100 is attached to the PBR 32 and the sleeve 130 is in the first position. FIG. 9B illustrates the running tool 400 and the packer actuator 300. The running tool 400 is in the locked position. The seat sleeve 420 is held in the closed position by the shearable plugs 430. The second nut 476 is in the first position to maintain the latch mechanism 570 in engagement with the profile 516. FIG. 9C illustrates the packer 500 in the unset position. FIG. 9D illustrates the liner hanger 600 and the packoff 700. The liner hanger 600 is in the unset position and the packoff 700 is the engaged position. The chamber 900 is isolated from fluid communication with the central bore 21 by the one or more shearable plugs 430.

Once the liner string 10 is at setting depth, an object 60, such as a ball or dart, may be dropped into the central bore 21 from the surface. The object 60 travels through the central bore 21 until it engages the seat 424. Pressure is increased above the object 60 engaged with the seat 424 until the shearable plug 430 shears and the seat sleeve 420 moves to the open position. Once the shearable plug 430 is sheared, the flow bore 434 is exposed to allow fluid communication between the central bore 21, the chamber 900, and the piston chamber 635. The liner hanger 600 is then set. Fluid pressure is further increased above the object 60 until the pressure acting on the piston head 631h of the piston member 631 is sufficient to shear the one or more shearable members 634 and to move the slips 624 into engagement with the casing 50. Setting the liner hanger 600 results in the bonnet 200 being displaced.

Figure 10A:
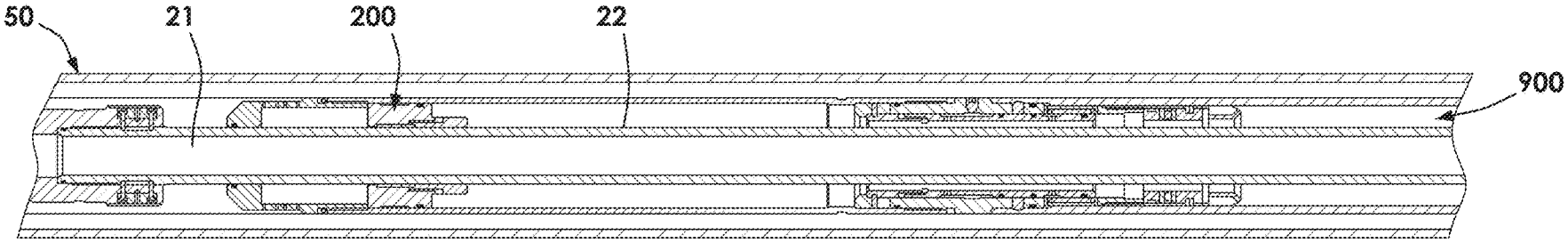
Figure 10B:
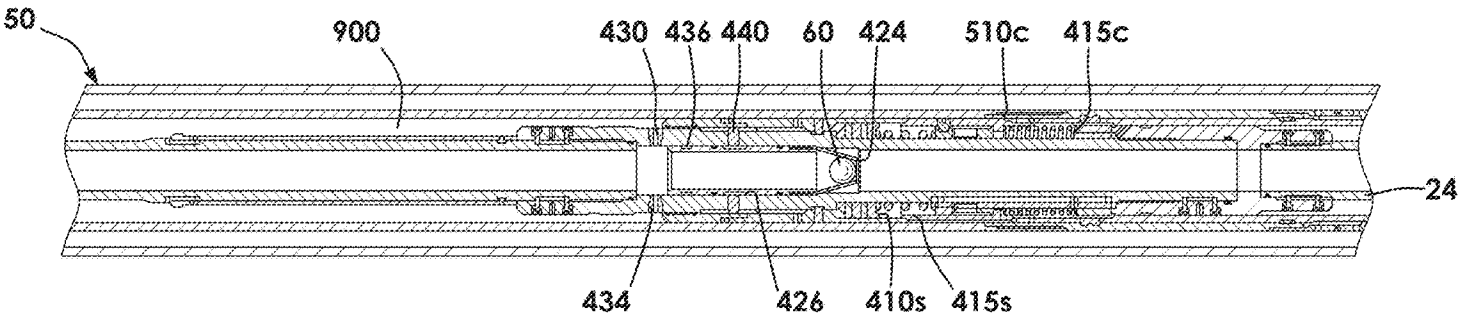
Figure 10C:
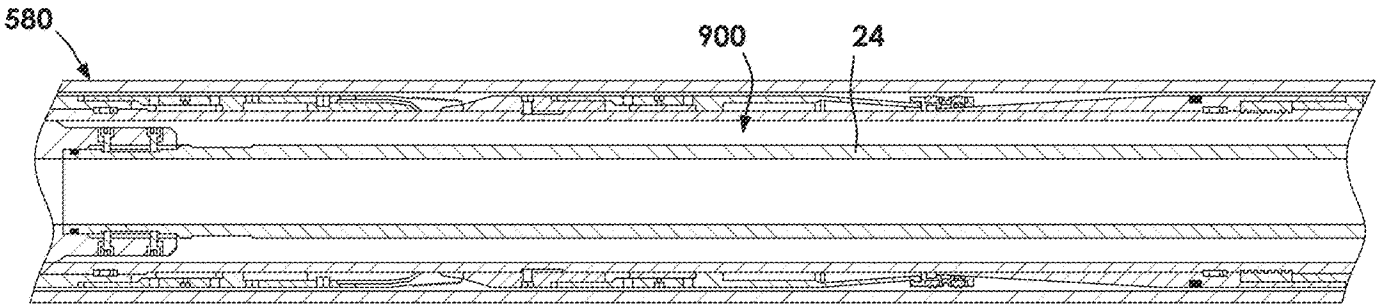
Figure 10D:
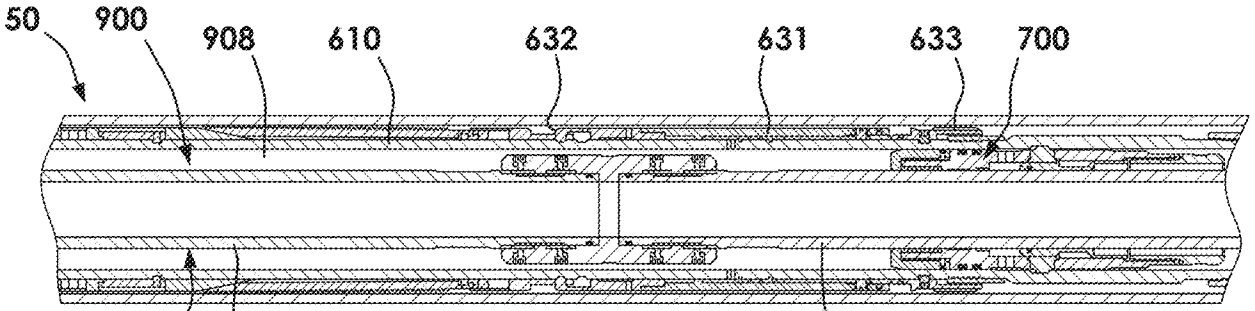

FIGS. 10A, 10B, 10C, and 10D illustrate the liner string 10 after the liner hanger 600 has been set. As shown in FIG. 10A, the bonnet 200 has moved relative to the connector 100 due the fluid introduced into the chamber 900 via the open flow bore 434 during the setting of the liner hanger 600. The connector 100 is still attached to the PBR 32. As shown in FIG. 10B, the running tool 400 has been actuated such that the seat sleeve 420 is in the open position and the chamber 900 is in fluid communication with the central bore 21 via the flow bore 434. The second nut 476 is still in the first position to maintain the latch mechanism 570 in the radially extended position. In FIG. 10C, the packer 500 remains in the unset position. FIG. 10D illustrates the liner hanger 600 in the set position. The packoff 700 remains in the engaged position and in sealing engagement with both the outer surface of the third tubular 26 and the inner surface of the tubular mandrel 610.

After the liner hanger 600 has been set, the running tool 400 is released from the LHA 30 as discussed above. The latch mechanism 570 no longer axially locks the outer sleeve 515 and the tubular mandrel 510 of the packer 500. The object 60 may be removed from the seat 424 prior to, during, or after the release of the running tool 400. In one example, the object 60 is extruded from the seat 424.

Figure 11A:
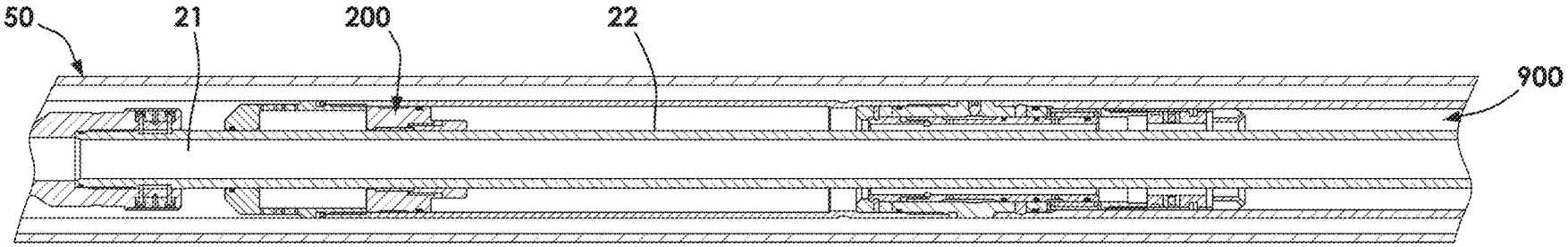
Figure 9B:
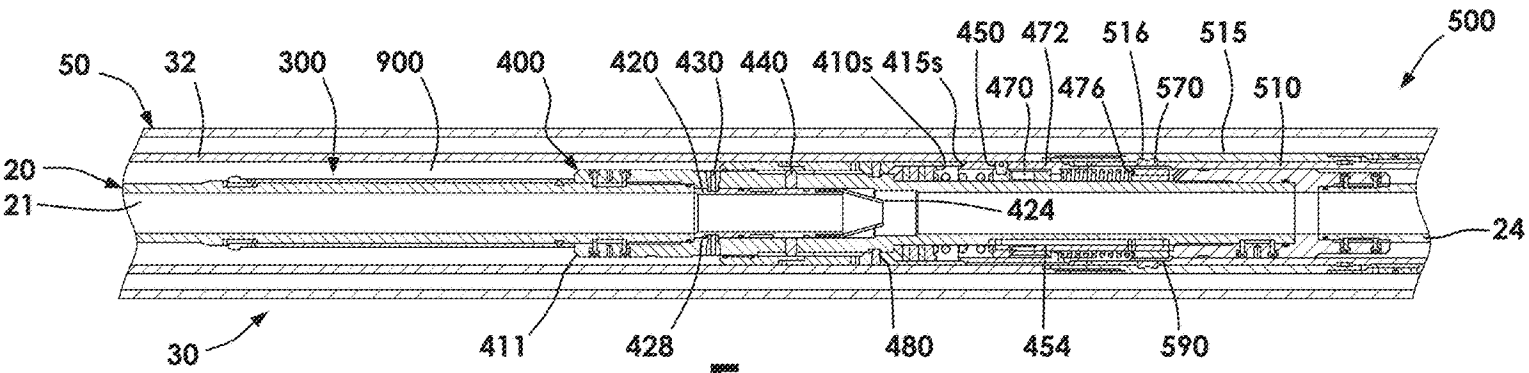
Figure 11B:
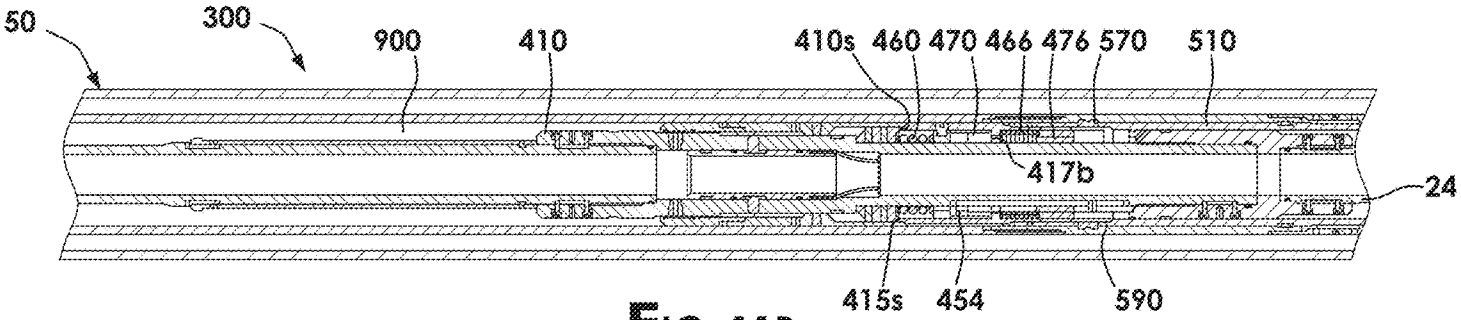
Figure 9C:
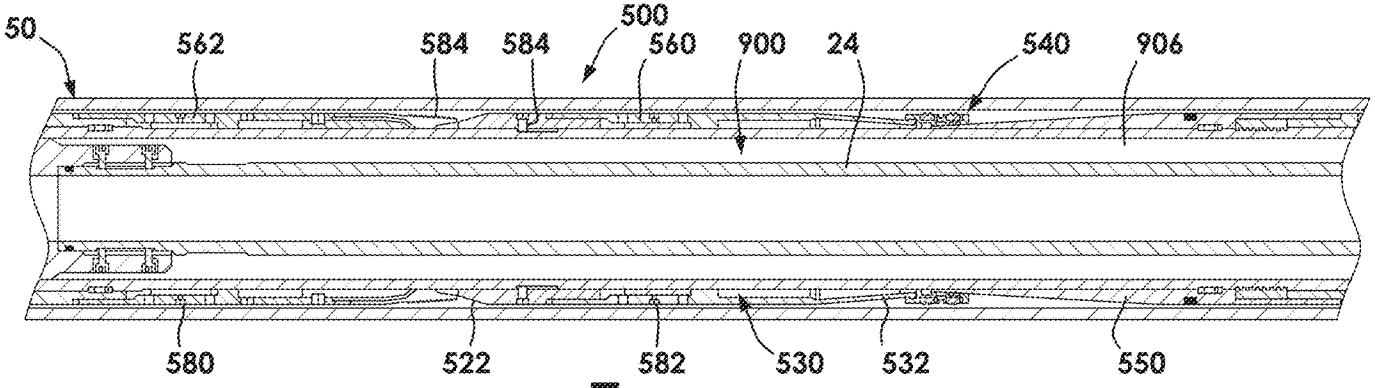
Figure 11C:
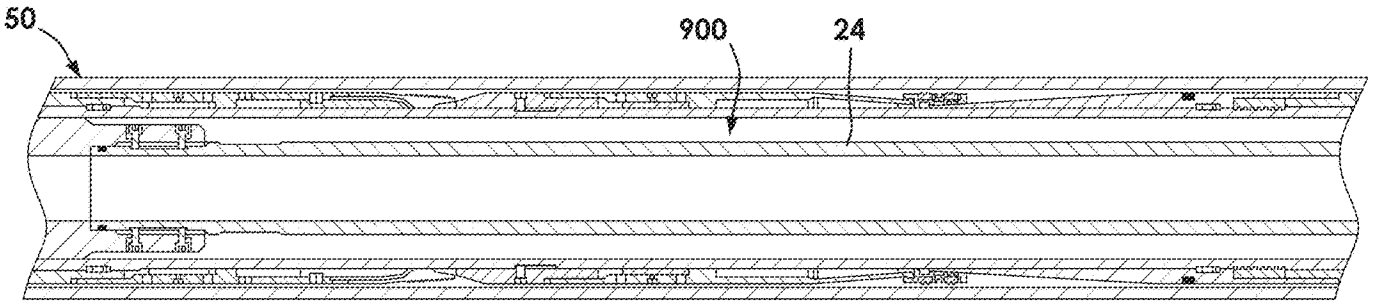
Figure 9D:
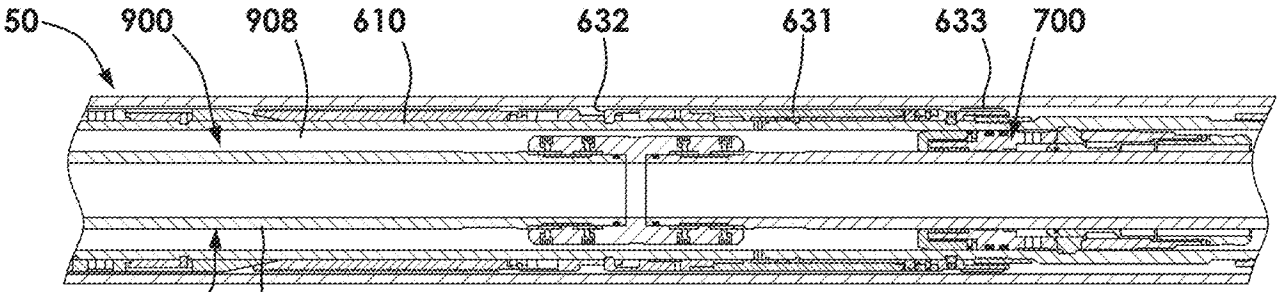
Figure 11D:
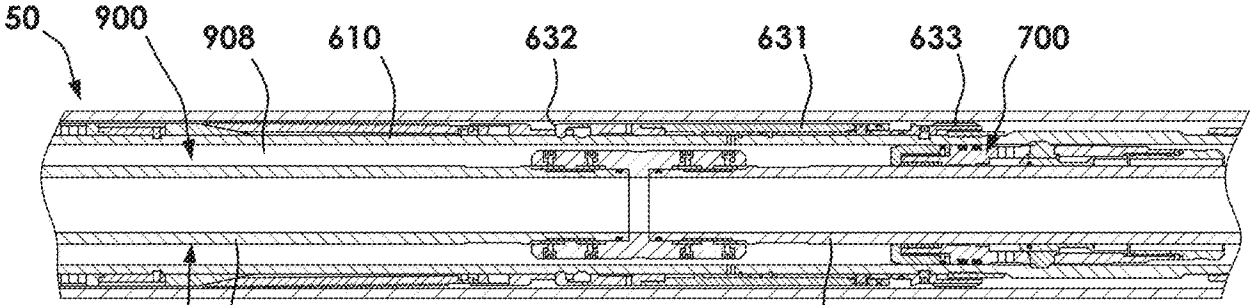

FIGS. 11A, 11B, 11C, and 11D illustrate the liner string 10 after the running tool 400 has been released from the LHA 30. As shown in FIG. 11A, the first tubular 22 has moved relative to the connector 100 and the bonnet 200. This movement is the result of the force (e.g., weight) applied from the surface, which is transferred to the tubular body 410 to move the tubular body 410 axially relative to the body sleeve 415 to withdraw the keys 454. As shown in FIG. 11 B, the running tool 400 is in the unlocked position. The flow bore 434 is disposed between the seals 406, blocking flow between the central bore 21 and the chamber 900. As shown in FIG. 11C, the packer 500 has remained unset, and the second tubular 24 has moved relative to the packer 500. As shown in FIG. 11D, the liner hanger 600 remains set. The packoff 700 remains in the engaged position and in sealing engagement of with the outer surface of the third tubular 26 and the inner surface of the tubular mandrel 610.

After the running tool 400 is released from the LHA 30, a cementation operation may begin to cement the liner 34 in the casing 50. Fluid, such as a mud, may be circulated through the central bore 21 and up the annulus between the casing 50 and the liner string 10 to condition the wellbore fluids prior to introducing a fluid train having a cement into the central bore 21. Additional objects may be dropped into the central bore 21, such as objects to separate portions of the fluid train. The objects may be darts and/or balls. The objects may engage with the plug assembly 40. The plug assembly 40 may have one or more individual plugs. Cement and/or fluids used during the cementation operation do not enter the chamber 900 because it is isolated from fluid communication with the wellbore fluids and the central bore 21.

Figure 12A:
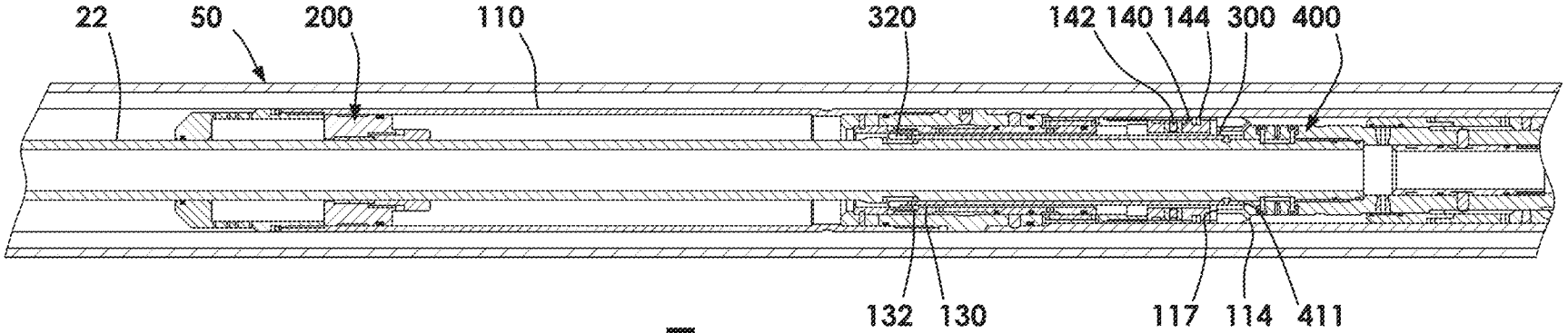
Figure 13A:
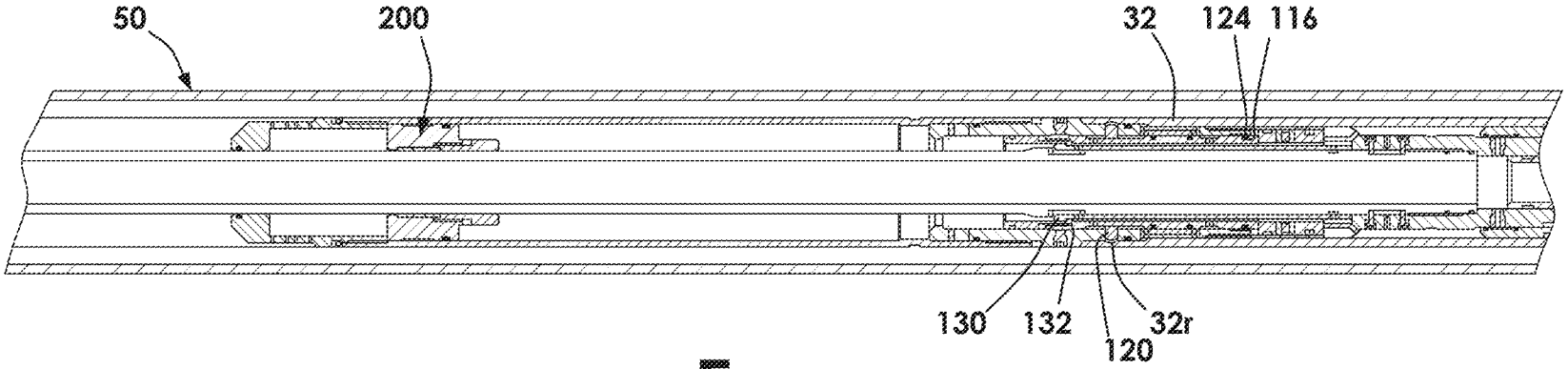
Figure 12B:
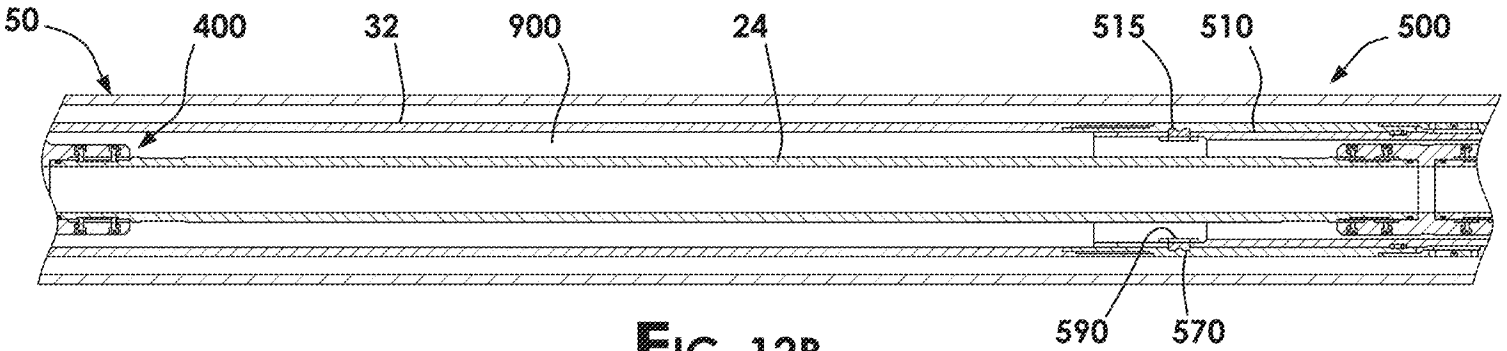
Figure 13B:
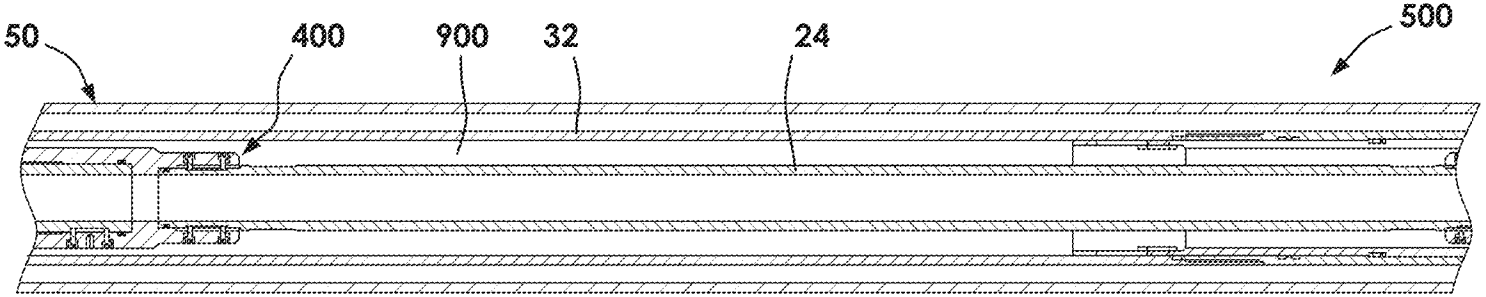
Figure 12C:
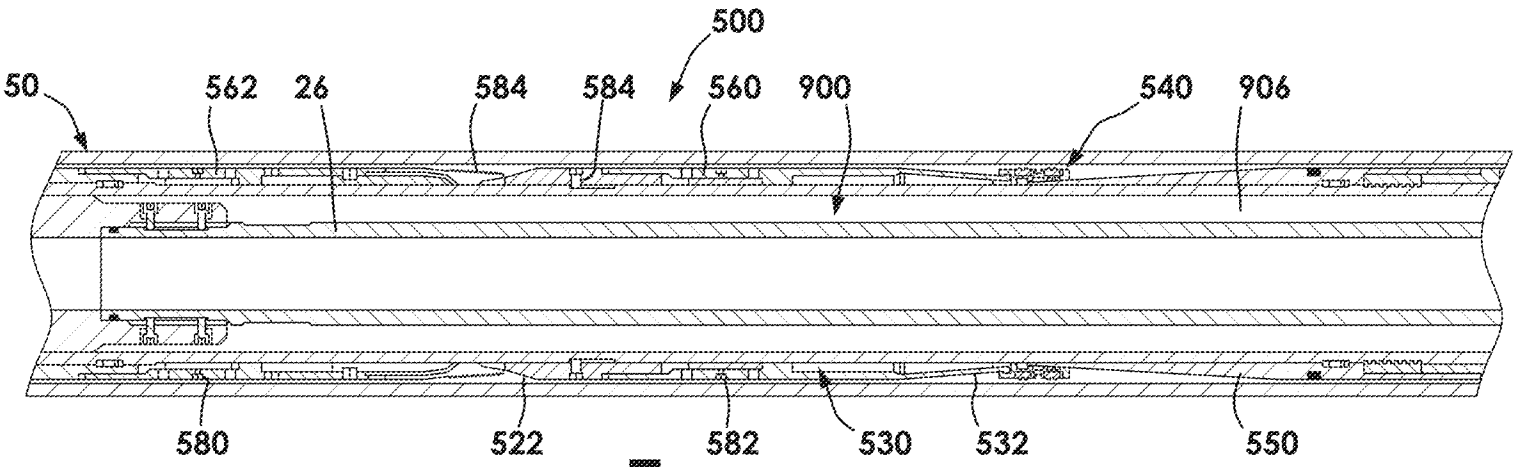
Figure 13C:
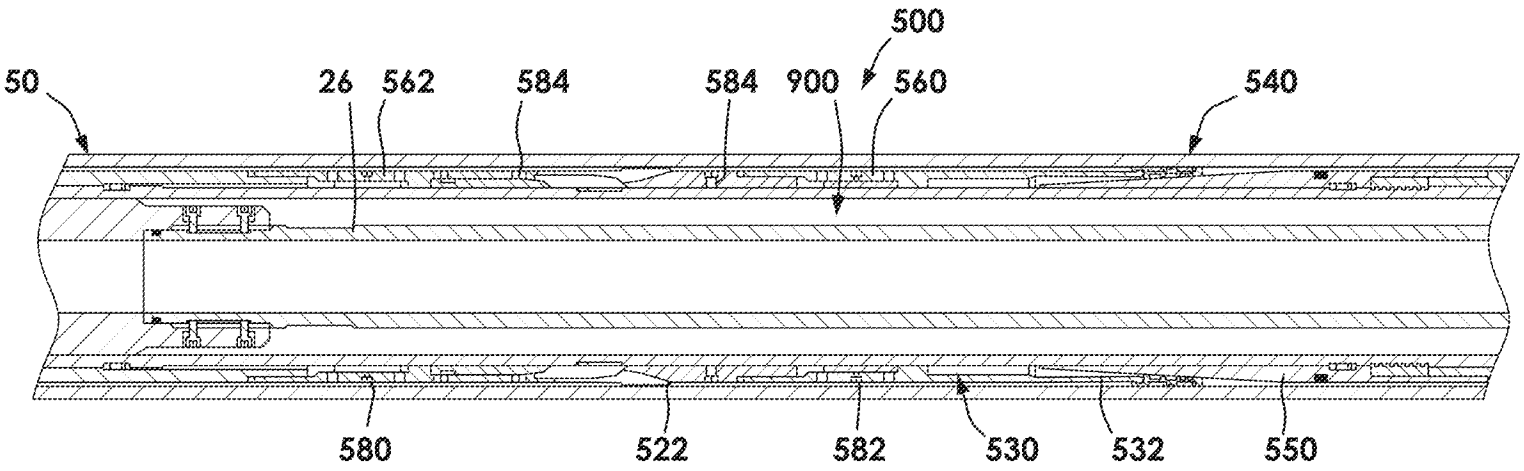
Figure 12D:
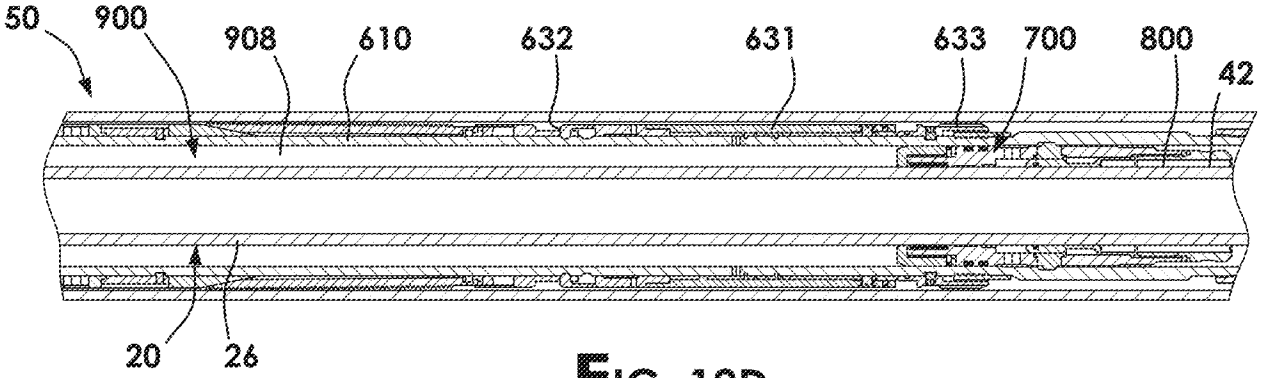
Figure 13D:
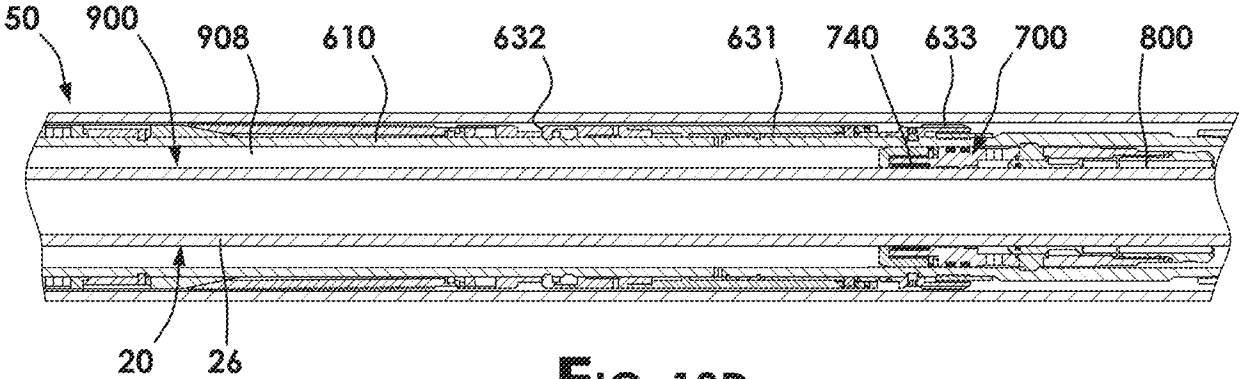

Once the cementation operation is complete, the packer 500 is ready to be set. To set the packer 500, the LHDA 20 is raised in order to engage the packer actuator 300 with the sleeve 130. FIGS. 12A, 12B, 12C, and12D illustrate the liner string 10 once the LHDA 20 is raised to raise the packer actuator 300. As shown in FIG. 12A, the first tubular 22 has moved relative to the connector 100 when the LHDA 20 is raised. The packer actuator 300 is positioned adjacent the sleeve 130. The catch shoulder 320 is disposed uphole from the first snap ring 132. The connector 100 is still attached to the PBR 32. As shown in FIGS. 12A-B, the running tool 400 has moved axially relative to the packer 500. As shown in FIG. 12A, the stop surface 411 of the running tool 400 has engaged the first shoulder 114. As shown in FIG. 12C, the packer 500 has remained unset. As shown in FIG. 12D, the liner hanger 600 remains set, and the packoff 700 is in the engaged position. While the LHDA 20 has been raised to engage the packer actuator 300 with the sleeve 130, the packoff 700 is not raised relative to the LHA 30 due to the engagement of the dogs 760 with the recesses 660. However, the third tubular 26 having the seal bypass 800 has moved axially relative to the packoff 700. The seal bypass 800 is positioned adjacent the seal stack 740, thereby allowing fluid communication around the seal stack 740. Thus, the chamber 900 is placed in fluid communication with the wellbore fluids.

Once the packer actuator 300 has been raised above the first snap rings 132, force (e.g., weight) may be applied to the LHDA 20. The catch shoulder 320 engages the snap ring 122, transferring the force applied to the LHDA 20 to the sleeve 130. The force causes the one or more shearable members 150 to shear, allowing the sleeve 130 to move from the first position to the second position. As the sleeve 130 moves, the second snap ring 134 expands into the groove 116. The recess 136 is positioned adjacent the dogs 120 which allows the dogs 120 to move to the radially retracted position. Once the dogs 120 are no longer in the radially extended position, the connector 100 is released from the PBR 32. The sleeve 130 also moves into engagement with the thrust bearing assembly 140. The force applied to the sleeve 130 is applied to the thrust bearing assembly 140, which causes the one or more shearable members 144 to shear. The sleeve 130 and the thrust bearing assembly 140 move axially relative to the tubular body 110 until the thrust bearing assembly 140 seats against the third shoulder 117. Once the thrust bearing assembly 140 engages the third shoulder 117, force applied to the LHDA 20 from the surface is transferred to the PBR 32 via the second shoulder 115. The force applied to the PBR 32 mechanically actuates the packer 500 as discussed above. The LHDA 20 may be rotated during the actuation of the packer 500. The thrust bearing 142 facilitates rotation of the LHDA 20 from the surface while the packer 500 is set if the LHDA 20 is rotated while the packer 500 is set.

FIGS. 13A, 13B, 13C, and 13D illustrate the liner string 10 after the packer 500 has been actuated. As shown in FIG. 13A, the sleeve 130 is in the second position and the connector 100 is released from the PBR 32. As shown in FIGS. 13A, 13B, the running tool 400 moved downhole relative to its position in FIGS. 12A, 12B. As shown in FIG. 13C, the packer 500 is in the set position. In FIG. 13D, the liner hanger 600 remained set and the packoff 700 is in the engaged position. The seal bypass 800 has moved relative to the packoff 700. However, the seal bypass 800 is still positioned adjacent the seal stack 740 such that the chamber 900 remains in fluid communication with the wellbore fluids.

Once the packer 500 is set, the LHDA 20 can be retrieved from the LHA 30. As the LHDA 20 is tripped out of the LHA 30, the plug assembly 40 or catch shoulder 42 catches the lock sleeve 750 and causes the lock sleeve 750 to move to the unlocked position. When the lock sleeve 750 is in the unlocked position, the dogs 760 are allowed to move to the radially retracted position such that the packoff 700 is in the disengaged position. The seal bypass 800 allows the fluid above the packoff 700 in the chamber 900 to drain as the packoff 700 moves uphole. Packoff 700 is then tripped out of the LHA 30 with the continued withdrawal of the LHDA 20.

In one embodiment, in the event the seat sleeve 420 does not covert to the open position, then sufficient force may be applied to the LHDA 20 to shear the shear ring 416. The liner string 10 may be landed on the bottom of the wellbore to facilitate shearing of the shear ring 416. Once the shear ring 416 shears, the running tool 400 can be unlocked. Cementation operations may begin and the packer 500 may be set. Because the liner string 10 is landed on the bottom of the wellbore, then the liner hanger 600 is not set.

Figure 14:
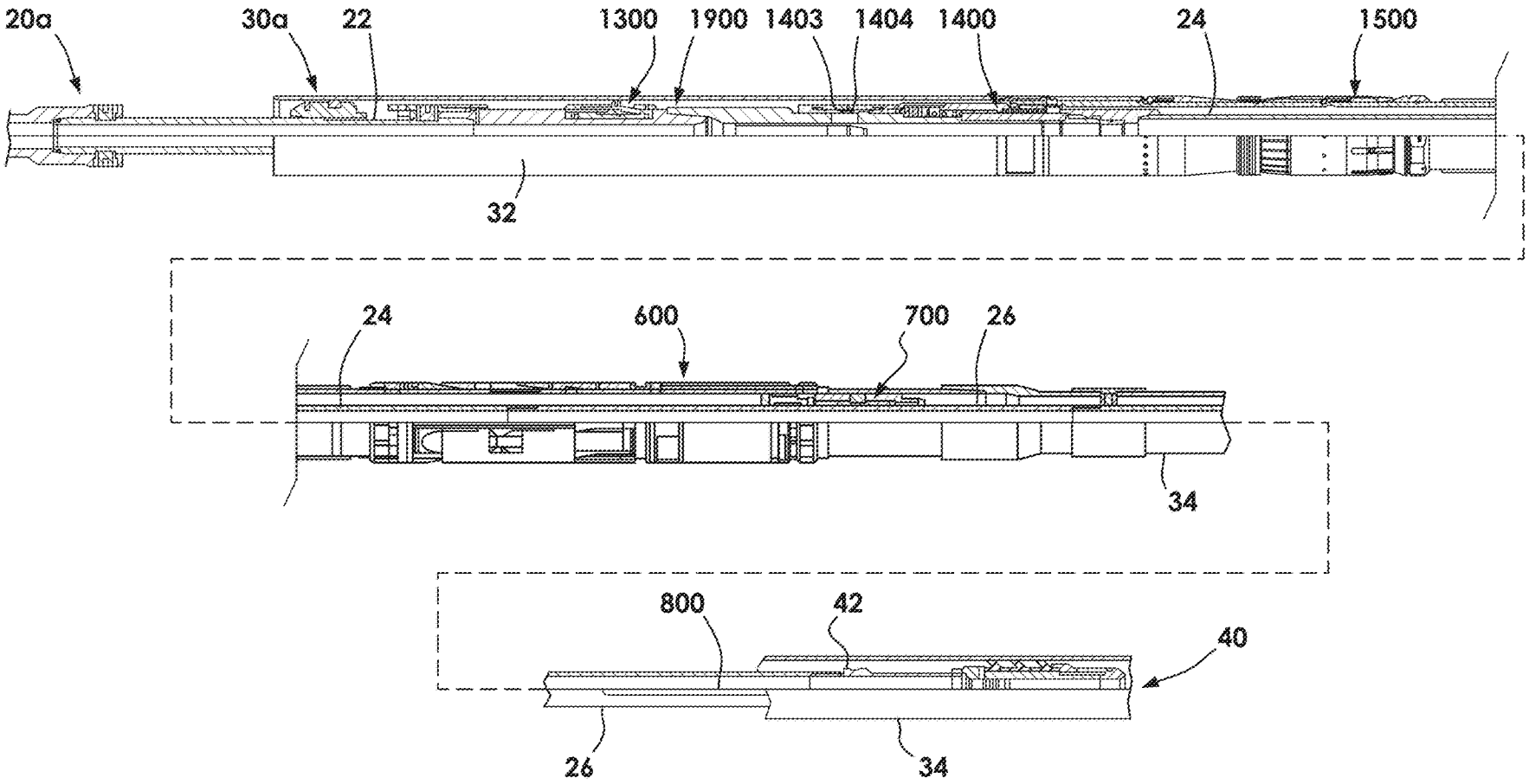
FIG. 14 illustrates a cross sectional view of an embodiment of a liner string.

FIG. 14 illustrates another embodiment of a liner string 10*a* having a LHDA 20*a* and a LHA 30*a*. The LHDA 20*a* may include the bonnet 200, a packer actuator 1300, a running tool 1400, the packoff 700, the seal bypass 800, the plug assembly 40, the first tubular 22, the second tubular 24, and the third tubular 26. The LHDA 20*a* has a central bore 21*a*. One end of the first tubular 22 is connected to the tubular string suspended from the surface while the other end is connected to the packer actuator 1300. One end of the second tubular 24 is connected to the running tool 1400 while the other end is connected to one end of the third tubular 26. The other end of the third tubular 26 is connected to the plug assembly 40.

The LHA 30*a* may include the PBR 32, the liner 34, a packer 1500, and the liner hanger 600. The LHA 30*a* may also include a float collar (not shown) and float shoe (not shown) at a lower end.

As shown in FIG. 14, a chamber 1900 is present between the LHDA 20*a* and the LHA 30*a*. During run-in of the liner string 10*a*, the LHDA 20*a* is disposed in the LHA 30*a*. The LHDA 20*a* is attached to the LHA 30*a* by the engagement of the running tool 1400 with the LHA 30*a*, such as with the packer 500. The chamber 1900 is isolated from the annulus surrounding the liner string 10*a* and the central bore 21*a* of the LHDA 20*a*. Circulation through the liner string 10*a* may be increased during run-in to facilitate moving the liner string 10*a* through deviations and/or turns in the wellbore. The running tool 1400 prevents premature actuation of the liner hanger 600 during run-in of the liner string 10*a*. Once run-in of the liner string 10*a* is complete, the running tool 1400 is actuated to allow fluid communication between the central bore 21*a* and the chamber 1900. Once fluid communication between the central bore 21*a* and the chamber 1900 is established, the liner hanger 600 may be actuated in response reaching the pressure threshold. In some embodiments, the running tool 1400 can be actuated prior to the completion of run-in once the liner string 10*a* is close to the setting depth of the liner hanger 600.

The LHDA 20*a* does not include the connector 100. The outer seal 220 of the bonnet 200 is configured to sealing engage the inner surface of PBR 32. The upper piston area 240 is in fluid communication with the wellbore fluids. The lower piston area 250 is in fluid communication with the chamber 1900. The chamber 1900 is sealingly bounded at an upper end by the bonnet 200 and sealing bounded at a lower end by the packoff 700.

The packer actuator 1300 may be similar to the packer actuator disclosed in U.S. Pat. No. 9,322,235, which is herein incorporated by reference. The packer actuator 1300 includes dogs 1320 configured to engage the upper end of the PBR 32. The dogs 1320 are maintained in a radially retracted position by the inner surface of the PBR 32. To set the packer 1500, the LHDA 20*a* is lifted relative to the LHA 30*a* so that the packer actuator 1300 is withdrawn from the PBR 32. Once the packer actuator 1300 is withdrawn from the PBR 32, the dogs 1320 move to a radially extended position. The dogs 1320 may then be engaged with the upper end of the PBR 32 by lowering the LHDA 20*a*. Force may be applied to the LHDA 20*a* to set the packer actuator 1300, because the dogs 1320 transfer the force applied to the LHDA 20*a* to the PBR 32.

Figure 15:
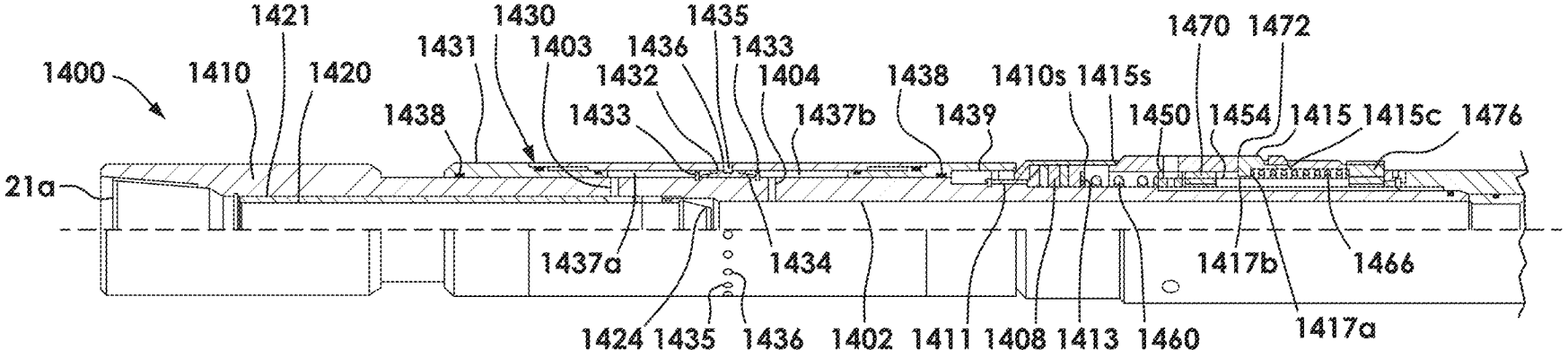
FIG. 15 illustrates a partial cross sectional view of an embodiment of the running tool shown in FIG. 14.

An exemplary embodiment of the running tool 1400 is shown in FIG. 15. The running tool 1400 is shown in a locked position. The running tool 1400 may include a thrust bearing 1408, a tubular body 1410, a body sleeve 1415, a seat sleeve 1420, a piston assembly 1430, a keyway ring 1450, a plurality of keys 1454, a first biasing member 1460, a second biasing member 1466, a first nut 1470, and a second nut 1476. The tubular body 1410 may be one integral component, or it may be composed of multiple sections. The tubular body 1410 defines a bore 1402. One end of the first tubular 22 is connected to the tubular body 1410. The tubular body 1410 has one or more first ports 403, one or more second ports 404, one or more latch keys 1411, a first shoulder 1410*s*, and a second shoulder 1413. The body sleeve 1415 is disposed about the tubular body 1410. The body sleeve 1415 may include a first shoulder 1415*s*, a second shoulder 1417*a*, a third shoulder 1417*b*, castellations 1415*c*, and threads 1472. The body sleeve 1415 may be one integral component, or it may be composed of multiple sections. The castellations 1415*c* correspond to the castellations 1510*c* of the packer 1500.

A seat sleeve 1420 is disposed in the bore 1402. The seat sleeve 1420 may include a seat 1424. The seat sleeve 1420 may be moveable relative to the tubular body 1410. One or more seals 1422 may be disposed between the seat sleeve 1420 and the tubular body 1410. An annulus 1421 is disposed between the seat sleeve 1420 and tubular body 1410, allowing fluid communication between the central bore 21*a* and the first port 1403. The central bore 21*a* includes the bore 1402.

The keyway ring 1450 includes keyways (not shown) for receiving to the keys 1454. The keyway ring 1450 may be attached to or integral with the body sleeve 1415. Each keys 1454 is coupled to the tubular body 1410 and is disposed in a respective keyway when the running tool 1400 is in the locked position. When the keys 1454 are disposed in the keyway ring 1450, then the tubular body 1410 is torsionally locked with the body sleeve 1415.

The first nut 1470 has outer threads and is threadedly coupled to the threads 1472 of the body sleeve 1415. The first nut 1470 is configured to travel along the threads 1472 from a first position to a second position in response to the rotation of the running tool 1400 relative to the LHA 30*a*. The second nut 1476 has outer threads and is threadedly coupled to the threads 1590 formed on the surface of the tubular mandrel 1510. The second nut 1476 is configured to travel along the threads 1590 from a first position to a second position in response to the rotation of the running tool 1400 relative to the LHA 30*a*. The first biasing member 1460, such as a spring, is disposed between the second shoulder 1413 and the keyway ring 1450. The second biasing member 1466, such as a spring, is disposed between the second shoulder 1417*a* and the second nut 1476. The first and second biasing members 1460, 1466 bias the running tool 1400 in the locked position. When the second nut 1476 is in the first position, the second nut 1476 maintains the latch mechanism 1570 of the packer 1500 in a radially extended position.

The threads of the first nut 1470 and the threads 1472 may have a finer pitch, be greater in number, and run in an opposite rotational direction than the threads of the second nut 1476 and the threads 1590. The difference in pitch allows greater axial displacement of the second nut 1476 as compared to the first nut 1470 per rotation. Thus, the second nut 1476 may be disengaged from the threads 1590 before the first nut 1470 engages the third shoulder 1417*b*.

The first nut 1470 has keyways (not shown) for receiving the keys 1454. The second nut 1476 has keyways (not shown) for receiving the keys 1454. The first and second nuts 1470, 1476 are moveable axially relative to the tubular body 1410 from their respective first position to their respective second position along the keys 1454. The keys 1454 may move relative to the first and second nuts 1470, 1476 in their respective keyways. The keys 1454 transfer torque from the tubular body 1410 to the first and second nuts 1470, 1476 to facilitate their rotation relative to the tubular body 1410. The keys 1454 and the first nut 1470 comprise a lock assembly to transmit torque from the tubular body 1410 to the body sleeve 1415 once the first nut engages the third shoulder 1417*b*. However, the running tool 1400 may be withdrawn from the LHA 30*a* when the first nut 1470 is in the second position.

The running tool 1400 is movable from the locked position to an unlocked position. When in the unlocked position, the running tool 1400 is released from the LHA 30*a*, such as being released from the packer 1500. To unlock the running tool 1400, the tubular body 1410 moves axially relative to the body sleeve 1415, compressing the first biasing member 1460. The tubular body 1410 moves axially relative to the body sleeve 1415 until the first shoulder 1410*s* engages the first shoulder 1415*s*. The axial movement of the tubular body 1410 relative to the body sleeve 1415 withdraws the keys 1454 from the keyway ring 1450. Once the keys 1454 are withdrawn, the tubular body 1410 is no longer torsionally locked to the body sleeve 1415, allowing for the tubular body 1410 to be rotated relative to the body sleeve 1415 and the LHA 30*a*. The body sleeve 1415 is not rotatable with the tubular body 1410 due to the engagement of the castellations 1415*c*, 1510*c*. During the rotation of the tubular body 1410, the first nut 1470 advances along the threads 1472 from the first position to the second position. In the second position, the first nut 1470 is engaged with the third shoulder 1417*b*. During rotation, the second nut 1476 advances along the threads 1590 from the first position to the second position. The movement of the second nut 1476 compresses the second biasing member 1466. In the second position, the second nut 1476 is no longer threaded to the tubular mandrel 1510 via threads 1590 and no longer maintains the latch mechanism 1570 in the radially extended position. Once the second nut 1476 is in the second position, the running tool 1400 is in the unlocked position.

The piston assembly 1430 includes piston sleeve 1431, a seal assembly 1432, one or more shearable members 1435, and seals 1438. The piston sleeve 1431 is disposed about the tubular body 1410. The seal assembly 1432 is affixed to the tubular body 1410 by snap rings 1433. In some embodiments, the seal assembly 1432 is alternatively affixed to the piston sleeve 1431. The seal assembly 1432 includes seals 1434. The seal assembly 1432 divides the chamber between the piston sleeve 1431 and the tubular body 1410 into an upper chamber 1437*a* and a lower chamber 1437*b*. The upper chamber 1437*a* is in fluid communication with the first port 1403 and the lower chamber 1437*b* is in fluid communication with the second ports 1404. Piston sleeve 1431 further includes a plurality of openings 1436. The openings 1436 are isolated from the chambers 1437*a,b* via the seal assembly 1432. One or more shearable members 1435 are disposed in the openings 1436. In some embodiments, some openings 1436 do not have a shearable member 1435 disposed therein. The shearable members 1435 are partially disposed in the openings 1436 and the seal assembly 1432. As shown in FIG. 15, the piston sleeve 1431 is retained in a closed position by the one or more shearable members 1435. The piston sleeve 1431 isolates the chamber 1900 from the central bore 21*a* when in the closed position. When the piston sleeve 1431 is in the closed position, the latch slots 1439 engage the latch keys 1411.

To actuate the piston sleeve 1431 from the closed position to an open position, an object (e.g., ball, dart) is dropped into the central bore 21*a*. Once the object engages the seat 1424, pressure may be increased above the seated object. The pressure in the upper chamber 1437*a* is increased due to the increase in pressure in the central bore 21*a*. The pressure in the lower chamber 1437*b* is not increased since it is isolated from the increased pressure by the object. Once the pressure differential between the chambers 1437*a*,b exceeds the shear strength of the one or more shearable members 1435, the one or more shearable members 1435 shear. The piston sleeve 1431 moves to the open position in response to the pressure in the upper chamber 1437*a*. When the piston sleeve 1431 is in the open position, the openings 1436 are no longer blocked by the seal assembly 1432. Thus, fluid communication is established between the central bore 21*a* and the chamber 1900 via the annulus 1421, the first port 1403, the upper chamber 1437*a*, and the openings 1436. Some openings 1436 may be obstructed by the remnants of the shearable members 1435. However, some sheared shearable members 1435 may allow fluid to pass through the openings 1436. Additionally, openings 1436 without shearable members 1435 allow fluid communication. Thus, a flow path between the central bore 21*a* and the chamber 1900 is established when the piston sleeve 1431 is in the open position. When the piston sleeve 1431 is in the open position, the latch slots 1439 are disengaged from the latch keys 1411.

In some embodiments, the seat sleeve 1420 includes one or more openings to allow fluid communication between the central bore 21*a* and the first port 1403 instead of or in addition to the annulus 1421.

Figure 16:
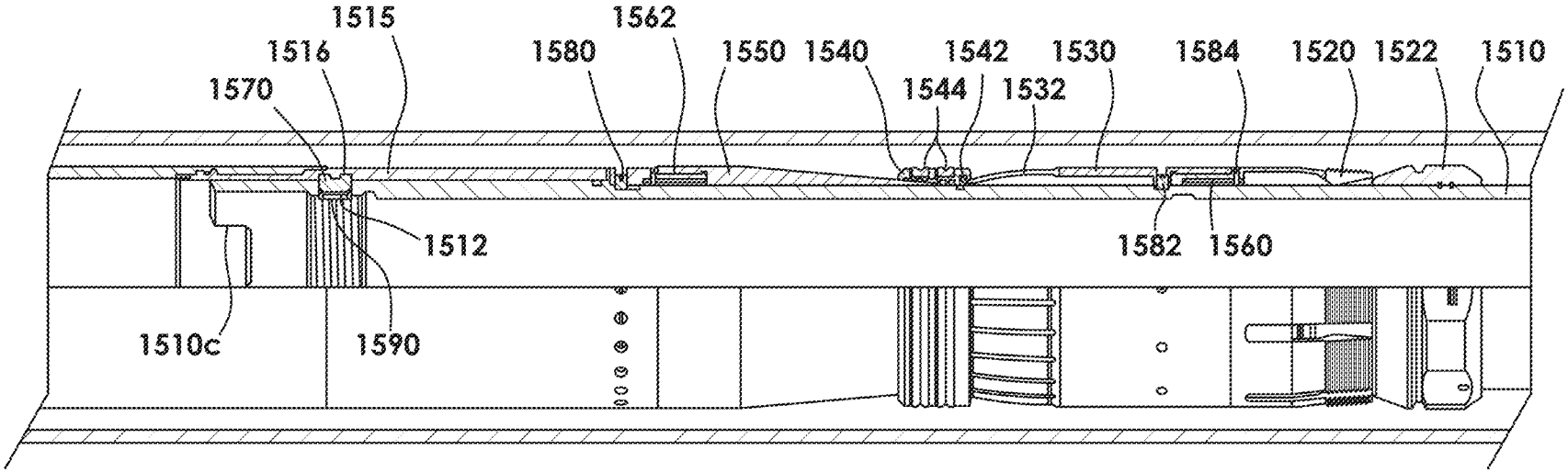
FIG. 16 illustrates a partial cross sectional view of an embodiment of a packer.

An exemplary packer 1500 in an unset position is illustrated in FIG. 16. The packer 1500 is mechanically actuated. The packer 1500 may include a tubular mandrel 1510, an outer sleeve 1515, a plurality of slips 1520, a gauge ring 1522, a retaining sleeve 1530, a packing element 1540, an expansion cone 1550, a first locking mechanism 1560, a second locking mechanism 1562, and a latch mechanism 1570. The tubular mandrel 1510 may include one or more openings 1512 and a plurality of castellations 1510*c* at one end that correspond to the castellations 1415*c*. The tubular mandrel 1510 may be one integral component, or it may be made out of multiple sections. The tubular mandrel 1510 includes threads 1590 corresponding to the second nut 1476. The gauge ring 1522 and expansion cone 1550 are coupled to the tubular mandrel 1510. The tubular mandrel 1510 is disposed in the outer sleeve 1515. The outer sleeve 1515 may be one integral component, or it may be made out of multiple sections. The outer sleeve 515 may include a profile 1516, and the outer sleeve 1515 may be threadedly engaged with the PBR 32. The outer sleeve 1515 is maintained in a first position by one or more shearable members 1580.

The retaining sleeve 1530 is disposed about the tubular mandrel 1510. The retaining sleeve 1530 may be retained in a first position by one or more shearable members 1582. The retaining sleeve 1530 includes a plurality of collet fingers 1532 at one end. The packing element 1540 is coupled to the retaining sleeve 1530 via the collet fingers 1532. The packing element 1540 has a body 1542 and one or more seals 1544. The packing element 1540 is configured travel along the expansion cone 1550 to expand from a radially retracted position to a radially expanded position as the expansion cone 1550 is forced under the packing element 1540. When the packing element 1540 is in the radially expanded position, it is configured to sealingly engage the inner surface of a casing or wellbore that the liner string 10*a* is disposed within. The first locking mechanism 1560 is configured to prevent the retaining sleeve 1530, and thus the packing element 1540, from travelling back down the expansion cone 1550 once the packing element 1540 has been expanded. The first locking mechanism 1560 may be a ratchet surface engaged with the tubular mandrel 1510.

The plurality of slips 1520 disposed about the tubular mandrel 1510. The outer sleeve 515 may be initially retained in a first position by one or more shearable members 1584. The slips 1520 are shown in the radially retracted position in FIG. 15. The slips 1520 are configured to travel along the gauge ring 1522 to move from the radially retracted position to a radially extended position in response to a mechanical actuation force. The first locking mechanism 1560 is configured to prevent the slips 1520, from travelling back down the gauge ring 1522 once the slips 1520 are in the radially extended position.

The expansion cone 1550 is configured to move relative to the tubular mandrel 1510. The expansion cone 1550 and the packing element 1540 may be configured to set the slips 1520 prior to the expansion of the packing element 1540. The expansion cone 1550 is forced under the packing element 1540 to expand the packing element 1540 to the radially expanded position. The second locking mechanism 1562 is configured to prevent the expansion cone 1550 from travelling uphole to prevent the packing element 1540 from unsealing from the wellbore or casing. The second locking mechanism 1562 may be a ratchet surface engaged with the tubular mandrel 1510.

The latch mechanism 1570 may be one or more dogs disposed in the openings 1512. The latch mechanism 1570 is configured to engage the profile 1516. The latch mechanism 1570 is configured to axially and torsionally lock the outer sleeve 1515 and tubular mandrel 1510 together when in a radially extended position. The latch mechanism 1570 is maintained in the radially extended position, and thus in engagement with the profile 1516, by the second nut 1476. When the running tool 1400 is in the unlocked position, the second nut 1476 no longer prevents the latch mechanism 1570 from disengaging the profile 1516, allowing the latch mechanism 1570 to move to a radially retracted position.

To actuate the packer 1500, the LHDA 20*a* is lifted to engage the dogs 1320 of the packer actuator 1300 with the upper end of the PBR 32. Force (e.g., weight) is then applied to the LHDA 20*a*. The force exerted on the PBR 32 is transferred to the outer sleeve 1515. After the shearable members 1580 shear, the outer sleeve 1515 and expansion cone 1550 moves relative to the tubular mandrel 1510. The expansion cone 1550 transfers the force to the packing element 1540. Once the shearable members 1582, 1584 shear, the slips 1520 travel along the ramps to the radially extended position. Once the slips 1520 are set against the wellbore or casing, the force causes the expansion cone 1550 to slide beneath the packing element 1540, thereby expanding the packing element 1540. The packer 1500 is in a set position once the packing element 1540 is in the radially expanded position.

Figure 17A:
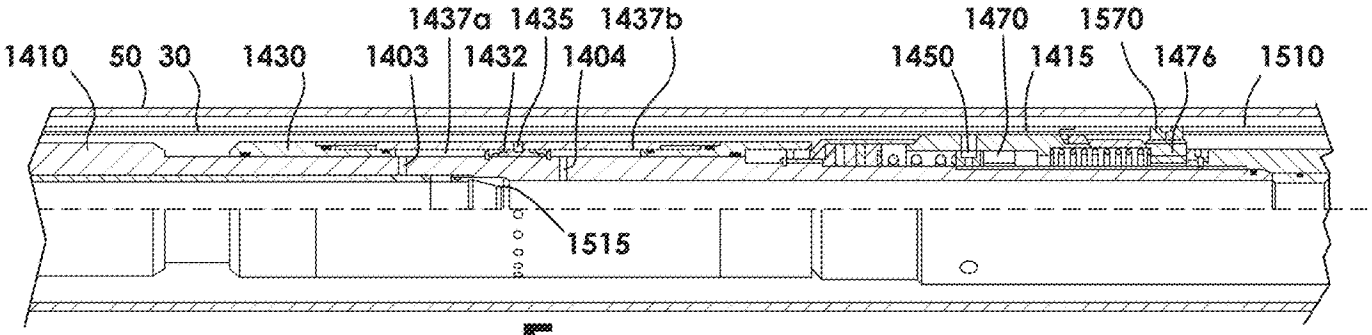
FIGS. 17A-17F illustrate an operational sequence of the running tool.

FIG. 17A-F illustrates the running tool 1400 and a portion of the packer 1500 disposed in the casing 50. The liner string 10*a* is at the setting depth of the liner hanger 600. FIG. 17A illustrates the running tool 1400 and the packer 1500 in position at the setting depth. The running tool 1400 is ready to begin the actuation sequence.

Figure 17B:
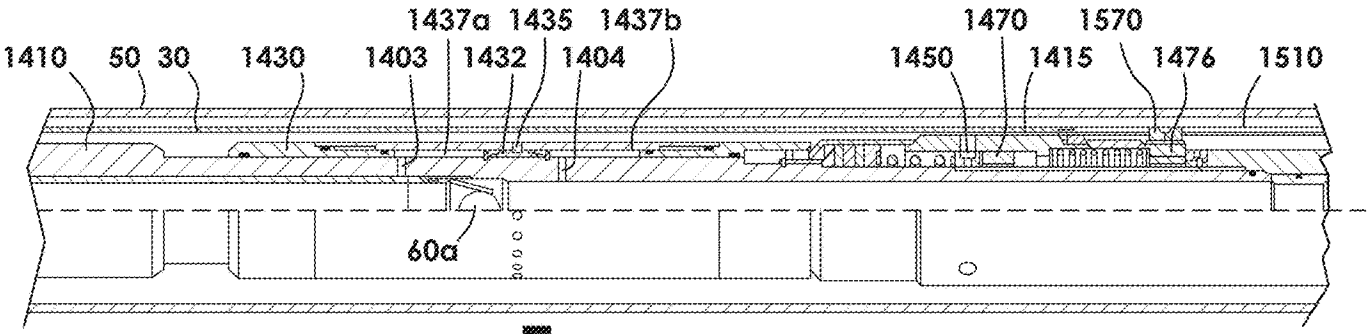

An object 60*a* (e.g., ball, dart) is dropped into the central bore 21*a*. The object 60*a* travels downhole until it engages with the seat 1424 as shown in FIG. 17B. The seated object 60*a* blocks flow in the central bore 21*a*. The first port 1403 and the second port 1404 are isolated from one another via the seated object 60*a*.

Figure 17C:
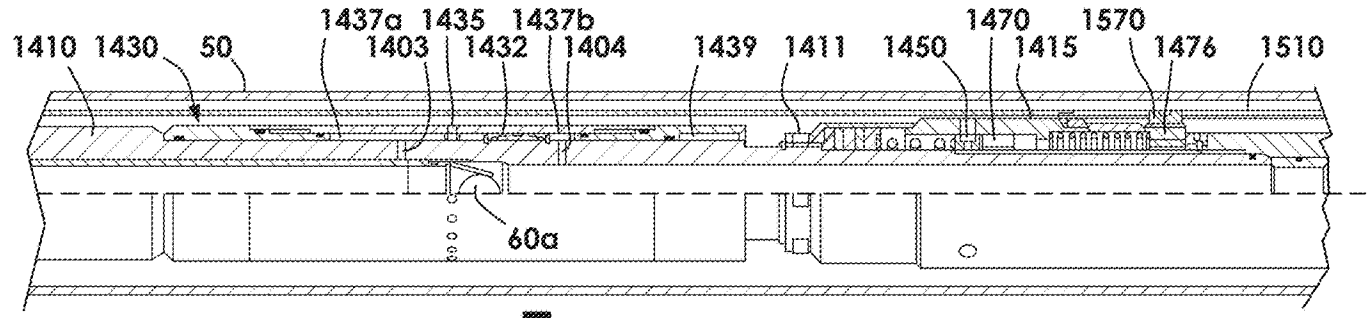

To actuate the piston assembly 1430, pressure is increased above the object 60*a*. In some embodiments, the seat sleeve 1420 will move relative to the tubular body 1410 in response to the pressure increase above the object 1430*a*. The increased pressure is communicated to the upper chamber 1437*a* via the first port 1403. Once the pressure differential between the chambers 1437*a,b* exceeds to shear strength of the one or more shearable members 1435, the shearable members 1435 shear. Once the shearable members 1435 shear, the piston sleeve 1431 moves relative to the tubular body 1410 from the closed position to the open position. Once the openings 1436 are no longer sealed by the seal assembly 1432, fluid communication is established between the chamber 1900 and the central bore 21*a* above the object 60*a*. FIG. 17C illustrates the piston assembly 1430 after it has been actuated. The piston sleeve 1431 is in the open position. While not shown, the bonnet 200 will have moved uphole in response to the fluid volume introduced into the chamber 1900 during the actuation of the liner hanger 600.

Pressure may be increased above the object 60*a* to increase the pressure in the chamber 1900 to actuate the liner hanger 600. The pressure in the chamber 1900 is communicated to the piston chamber 635, resulting in the setting of the slips 624.

Figure 17D:
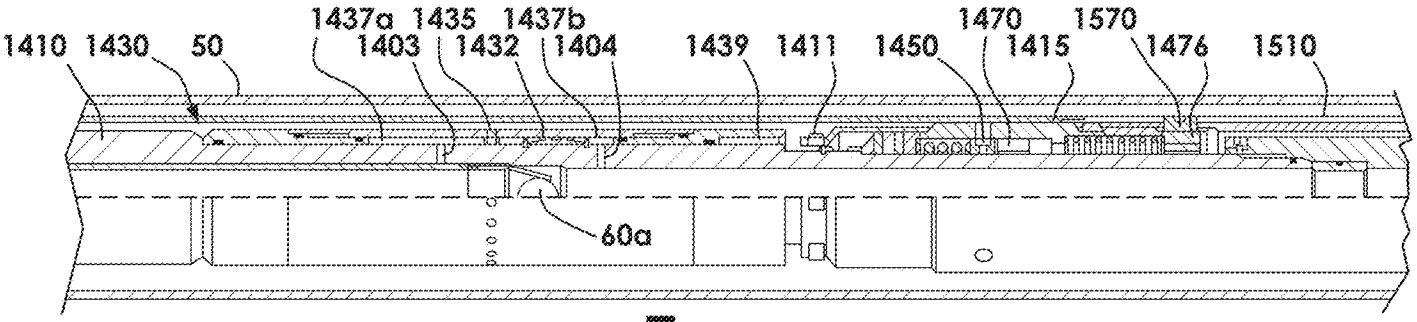
Figure 17E:
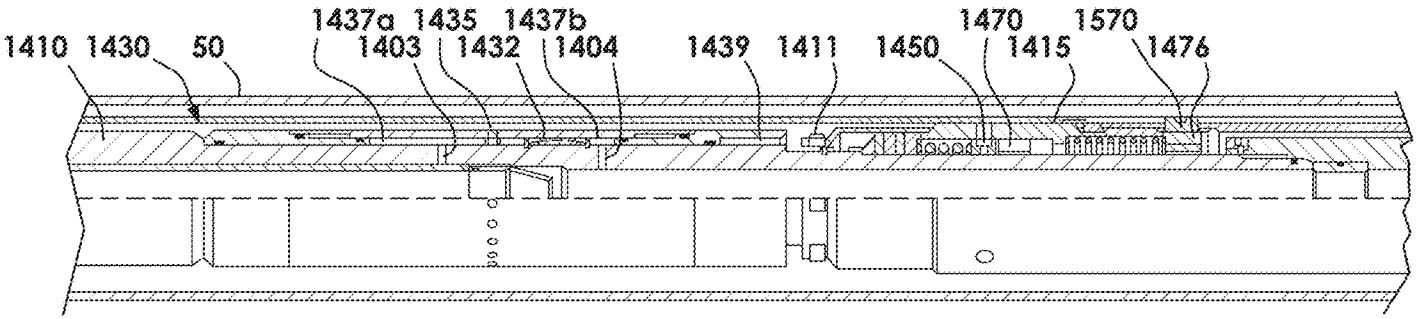

Once the liner hanger 600 is set, the running tool 1400 can be unlocked from the LHA 30*a*. As shown in FIG. 17D, force (e.g., weight) is applied to the LHDA 20*a* to move the tubular body 1410 relative to the body sleeve 1415 until the shoulders 1410*s*, 1415*s* engage and the keys 1454 are withdrawn from the keyway ring 1450. Once the keys 1454 are withdrawn, the object 60*a* may be removed from the seat 1424 as shown in FIG. 17E. In one example, the object 60*a* is extruded from the seat 1424. The object 60*a* may be removed from the seat 1424 prior to, during, or after the release of the running tool 1400.

Figure 17F:
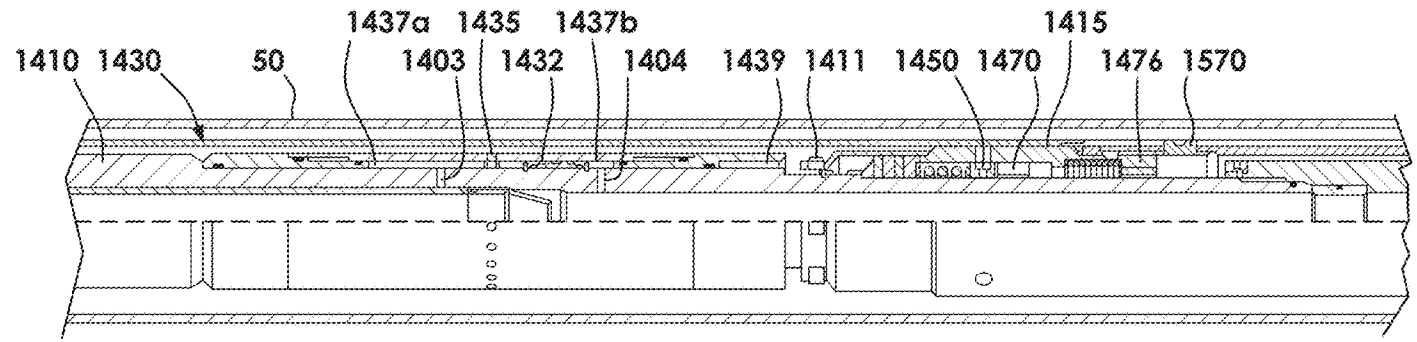

FIG. 17F illustrates the running tool in the unlocked position, and thus released from the LHA 30*a* as discussed above. The castellations 1415*c* and 1510*c* have not disengaged, nor has the packer 1500 been set. The second nut 1476 is in the second position and thus has disengaged the threads 1590 of the tubular mandrel 1510. The latch mechanism 1570 is no longer maintained in the radially extended position.

After the running tool 1400 is released from the LHA 30*a*, a cementation operation may begin to cement the liner 34 in the casing 50. Fluid, such as a mud, may be circulated through the central bore 21*a* of the LHDA 20*a* and up the annulus between the casing 50 and the liner string 10*a* to condition the wellbore fluids prior to introducing a fluid train having a cement into the central bore 21*a*. Additional objects may be dropped into the bore of the LHDA 20*a*, such as objects to separate portions of the fluid train. The objects may be darts and/or balls. The objects may engage with the plug assembly 40. The plug assembly 40 may have one or more individual plugs.

Once the cementation operation is complete, the packer 1500 is ready to be set. In order to set the packer 1500, the packer actuator 1300 is raised in order withdraw the dogs 1320. The seal bypass 800 is also raised such that it is positioned adjacent the seal stack 740 of the packoff 700. Force (e.g., weight) may then be applied to the LHDA 20*a* to set the packer 1500. The force is transferred to the packer 1500 via the engagement of the dogs 1320 with the upper end of the PBR 32. The force results in the actuation of the packer 1500 as described above.

Once the packer 1500 is set, the LHDA 20*a* can be retrieved from the LHA 30*a*. As the LHDA 20*a* is tripped out of the LHA 30, the plug assembly 40 and or a catch shoulder of the LHDA 20*a* engages the lock sleeve 750, which causes the lock sleeve 750 to move to the unlocked position. When the lock sleeve 750 is in the unlocked position, the dogs 760 are allowed to move to the radially retracted position such that the packoff 700 is in the disengaged position. The seal bypass 800 allows the fluid above the packoff 700 in the chamber 1900 to drain as the packoff 700 moves uphole. Packoff 700 is then tripped out of the LHA 30 with the continued withdrawal of the LHDA 20.

In some embodiments, the running tool 400, 1400 is actuated and the liner hanger 600 is set after the cementation operation.

In some embodiments, the running tool 400, 1400 is released from the LHA 30, 30*a* after the cementation operation.

While components of a liner string are described herein, it is envisioned that the running tools 400, 1400 and seal bypass 800 may be used with additional and/or different components of the liner string.

The running tools 400, 1400 are described setting liner hanger 500. However, the running tools 400, 1400 may be used in conjunction with a liner string that includes any hydraulically set liner hanger. Additionally, additionally, the liner string 10, 10*a* may include a packer, such as a mechanically set packer, other than the packers 500, 1500 discussed above. Additionally, the liner string 10, 10*a* may include a packoff other than the packoff 700 discussed above.

In one embodiment, a liner string for a wellbore includes a LHA and a LHDA releasably attached to the LHA. The LHDA includes a central bore and a running tool moveable from a locked position to an unlocked position, the running tool including a flow path in communication with the central bore. The liner string further includes a chamber disposed between the LHDA and LHA, wherein the chamber is in selective fluid communication with the flow path. Wherein, when the flow path is closed, the chamber is isolated from the central bore, and when the flow path is open, the flow path provides fluid communication between central bore and chamber.

In some embodiments of the liner string, the running tool further includes a shearable plug having the flow path, wherein the flow path is closed by a portion of the shearable plug, and a seat sleeve moveable from a closed position to an open position to shear away the portion of the shearable plug to open the flow path.

In some embodiments of the liner string, the flow path of the running tool is configured to close to prevent fluid communication between the chamber and the central bore when the running tool is in the unlocked position.

In some embodiments of the liner string, the running tool further includes a first port and a second port, wherein the first port and second port are in fluid communication with the central bore, and a piston assembly. The piston assembly includes a piston sleeve having an opening in fluid communication with the chamber, wherein the piston assembly is moveable from a closed position to an open position, and a seal assembly disposed between the first port and second port, wherein the seal assembly blocks the opening when the piston sleeve is in the closed position. Wherein the flow path is closed when the piston sleeve is in the closed position, and wherein the flow path is opened when the piston sleeve is in the open position.

In some embodiments of the liner string, the LHDA further includes a bonnet moveable with respect to the running tool and sealingly bounding an upper end of the chamber, and a packoff having a seal stack and sealingly bounding a lower end of the chamber.

In some embodiments of the liner string, the LHDA further including a seal bypass moveable from a first position to a second position adjacent the seal stack, wherein the seal bypass is configured to allow fluid communication between the chamber and a wellbore fluid when positioned adjacent the seal stack.

In some embodiments of the liner string, the LHDA further including a packer actuator; and a connector selectively attaches the LHDA to an upper portion of the LHA. Wherein the bonnet is moveably disposed within the connector, and wherein the connector is configured to detach from the upper portion of the LHA in response to a force applied by the packer actuator.

In some embodiments of the liner string, wherein the chamber includes water before the flow path is opened.

In some embodiments of the liner string, wherein the running tool includes a nut releasably attached to threads of a packer of the LHA. Wherein, when attached to the packer, the nut maintains a latch mechanism of the packer in a radially extended position, and when released from the packer, the nut is disengaged from the threads and the latch mechanism is movable to a radially retracted position.

In one embodiment, a liner string for a wellbore includes a LHA and a LHDA. The LHDA includes a running tool attached to the LHA in a locked position and released from the LHA in an unlocked position. The running tool including a tubular body having a bore, a body sleeve disposed about the tubular body, a shearable plug having a flow path and a closure member, wherein the closure member blocks the flow path from fluid communication with the bore, and a first sleeve moveable from a closed position to an open position to remove the closure member to expose the flow path. The liner string further includes a chamber formed between the LHA and LHDA and isolated from fluid communication with the bore when the first sleeve is in the closed position and when the running tool is in the unlocked position.

In some embodiments of the liner string, the LHDA further including a connector selectively attaching the LHDA to a polished bore receptacle (PBR) of the LHA, a bonnet disposed in the connector and moveable with respect to the connector and sealingly bounding an upper end of the chamber, and a packoff having a seal stack and sealingly bounding a lower end of the chamber.

In some embodiments of the liner string, the LHDA further including a seal bypass moveable from a first position to a second position adjacent the seal stack, wherein the seal bypass is configured to allow fluid communication between the chamber and a wellbore fluid when in the second position.

In some embodiments of the liner string, the LHDA further including a packer actuator, and wherein the connector is configured to detach from the PBR in response to a force applied by the packer actuator.

In some embodiments of the liner string, the connector further including a tubular body, a plurality of dogs disposed in the tubular body, the plurality of dogs having a radially extended position and a radially retracted position, and a second sleeve disposed in the tubular body, wherein the plurality of dogs are in the radially extended positionposition when the second sleeve is in a first position and wherein the plurality of dogs are in the radially retracted position when the second sleeve is in the second position.

In some embodiments of the liner string, the connector further includes a thrust bearing assembly moveable from a first position to a second positionposition in response to the movement of the second sleeve to the second position position.

In some embodiments of the liner string, the chamber is filled with a volume of water when the first sleeve is in the closed position.

In some embodiments of the liner string, further including a packer having a latch mechanism, wherein the latch mechanism is in a radially extended position when the running tool is in the locked position, and wherein the latch mechanism is in a radially retracted position when the running tool is in the unlocked position.

In one embodiment, a liner string includes a LHA and a LHDA. The LHDA includes a running tool releasably attached to the LHA. The running tool includes a tubular body having a bore, the tubular body having a first port and a second port in fluid communication with the bore. The running tool further includes a piston assembly including a piston sleeve having an opening, wherein the piston sleeve is moveable from a closed position to an open position, and a seal assembly disposed between the first port and the second port, the seal assembly configured to block the opening when the piston sleeve is in the closed position. The liner string further includes a chamber formed between the LHA and LHDA, wherein the chamber is isolated from fluid communication with the bore when the piston sleeve is in the closed position, and is in fluid communication with the bore when the piston sleeve is in the open position.

In some embodiments of the liner string, the chamber is in fluid communication with the bore via the first port and the opening.

In some embodiments of the liner string, the LHDA further includes a bonnet moveable with respect to the running tool and sealingly bounding an upper end of the chamber, and a packoff having a seal stack and sealingly bounding a lower end of the chamber.

In some embodiments of the liner string, the LHDA further including a seal bypass moveable from a first position to a second position adjacent the seal stack, wherein the seal bypass is configured to allow fluid communication between the chamber and a wellbore fluid when positioned adjacent the seal stack.

In some embodiments of the liner string, wherein the LHDA includes a packer actuator configured to actuate a packer of the LHA.

In some embodiments of the liner string, the chamber is filled with a volume of water when the piston sleeve is in the closed position.

In one embodiment, a method of operating a liner string includes deploying a liner string comprising a LHDA attached to a LHA into a wellbore, wherein a chamber is disposed between the LHDA and LHA and is isolated from a central bore of the LHDA. The method further includes actuating a running tool of the LHDA to open a flow path between the chamber and the central bore. The method further includes increasing pressure in the chamber to set a liner hanger of the LHA after actuating the running tool.

In some embodiments, the method of operating the liner string further includes moving the running tool from a locked position to an unlocked position to release the LHDA from the LHA after setting the liner hanger, wherein the flow path is closed when the running tool is in the unlocked position.

In some embodiments of the method of operating the liner string, the LHDA further includes a packer actuator, a connector attached to a polished bore receptacle (PBR) of the LHA, a seal bypass, and a packoff having a seal stack. The method further includes lifting the LHDA relative to the LHA to engage the packer actuator with the connector and to position the seal bypass adjacent the seal stack, wherein the chamber is in fluid communication with a wellbore fluid via the seal bypass.

In some embodiments, the method of operating the liner string further includes lowering the LHDA relative to the LHA to set a packer of the LHA and to release the connector from the PBR.

In some embodiments, the method of operating the liner string further includes removing the LHDA from the wellbore.

In some embodiments, the method of operating the liner string further includes moving the running tool from a locked position to an unlocked position to release the LHDA from the LHA after setting the liner hanger, wherein the flow path remains open when the running tool is in the unlocked position.

In some embodiments of the method of operating the liner string, the LHDA further including a packer actuator, a seal bypass, and a packoff having a seal stack. The method further includes lifting the LHDA relative to the LHA to engage the packer actuator with a polished bore receptacle (PBR) of the LHA and to position the seal bypass adjacent the seal stack, wherein the chamber is in fluid communication with a wellbore fluid via the seal bypass.

In some embodiments of the method of operating the liner string, wherein actuating the running tool includes engaging an object with a seat of a sleeve disposed in the central bore, and increasing pressure above the object to move the sleeve from a closed position to an open position, wherein the movement of the sleeve to the open position shears a shearable plug to open the flow path this is disposed within the shearable plug.

In some embodiments of the method of operating the liner string, wherein actuating the running tool includes engaging an object with a seat of a sleeve disposed in the central bore, thereby preventing fluid flow between a first port of the running tool and a second port of the running tool. The method further includes increasing pressure above the object to pressurize a first chamber between a piston sleeve and a tubular body of the running tool to move the piston sleeve from a closed positionposition to an open positionposition to open the flow path that is blocked by a seal assembly when the piston sleeve is in the closed position, wherein the seal assembly is disposed between the first and second ports.

While the foregoing is directed to embodiments of the present disclosure, other and further embodiments of the disclosure may be devised without departing from the basic scope thereof, and the scope thereof is determined by the claims that follow.

What is claimed is:

1. A running tool, comprising:

a tubular body including a central bore, a first port, and a second port;

a seat disposed in the central bore between the first port and the second port;

a piston sleeve disposed around the tubular body and moveable from a closed position to an open position, wherein the piston sleeve includes an opening;

a seal assembly disposed between the piston sleeve and the tubular body, wherein the seal assembly blocks fluid communication between the central bore and the opening when the piston sleeve is in the closed position; and a chamber disposed between the piston sleeve and the tubular body, wherein the seal assembly divides the chamber into a first chamber portion and a second chamber portion, wherein the first chamber portion is in communication with the first port and the second chamber portion is in communication with the second port, wherein the opening is in fluid communication with the central bore through the first chamber portion and first port when the piston sleeve is in the open position.

2. The running tool of claim 1, further comprising:

a first sleeve disposed in the tubular body and including the seat; and an annulus disposed between the first sleeve and the tubular body, wherein the annulus is in fluid communication with the first port and the central bore.

3. The running tool of claim 1, wherein the piston sleeve is releasable attached to the seal assembly in the closed position by a shearable member partially disposed in the opening and the seal assembly.

4. The running tool of claim 3, wherein the opening is a plurality of openings and the shearable member is a plurality of shearable members.

5. The running tool of claim 1, wherein a latch key of the tubular body is engaged with a latch slot of the piston sleeve when the piston sleeve is in the closed position, and wherein the latch key is disengaged from the latch slot when the piston sleeve is in the open position.

6. The running tool of claim 1, wherein the seal assembly is attached to the piston sleeve.

7. The running tool of claim 1, wherein the seal assembly is attached to the tubular body and the piston sleeve moves relative to the seal assembly from the closed position to the open position.

8. The running tool of claim 7, wherein the seal assembly is attached to the tubular body by snap rings.

9. The running tool of claim 1, further including:

a first nut and a second nut;

a body sleeve;

a keyway ring; and a plurality of keys.

10. A liner string, comprising:

a liner hanger assembly (LHA);

a liner hanger deployment assembly (LHDA), including:

a running tool releasably attached to the LHA, the running tool including:

a tubular body having a bore, the tubular body having a first port and a second port in fluid communication with the bore;

a piston assembly including:

a piston sleeve having an opening, wherein the piston sleeve is moveable from a closed position to an open position; and a seal assembly disposed between the first port and the second port, the seal assembly configured to block the opening when the piston sleeve is in the closed position;

a chamber formed between the LHA and LHDA, wherein the chamber is isolated from fluid communication with the bore when the piston sleeve is in the closed position, and is in fluid communication with the bore when the piston sleeve is in the open position.

11. The liner string of claim 10, wherein the chamber includes water prior to moving the piston sleeve to the open position.

12. The liner string of claim 10, the running tool further including:

a first sleeve disposed in the bore including a seat; and an annulus around the first sleeve, wherein the annulus is in fluid communication with the first port and the bore.

13. The liner string of claim 10, wherein the piston sleeve is releasable attached to the seal assembly in the closed position by a shearable member partially disposed in the opening and the sealing assembly.

14. The liner string of claim 10, wherein the seal assembly is attached to the tubular body and the piston sleeve moves relative to the sealing assembly from the closed position to the open position.

15. The liner string of claim 14, wherein the seal assembly is attached to the tubular body by snap rings.

16. The liner string of claim 10, the LHDA further including:

a bonnet moveable with respect to the running tool and sealingly bounding an upper end of the chamber; and a packoff having a seal stack and sealingly bounding a lower end of the chamber.

17. The liner string of claim 16, the LHDA further including a seal bypass moveable from a first position to a second position adjacent the seal stack, wherein the seal bypass is configured to allow fluid communication between the chamber and a wellbore fluid when positioned adjacent the seal stack.

18. A method of operating a liner string, comprising:

deploying a liner string comprising a liner hanger deployment assembly (LHDA) attached to a liner hanger assembly (LHA) into a wellbore, wherein a first chamber is disposed between the LHDA and LHA and is isolated from a central bore of the LHDA by a running tool of the LHDA;

actuating the running tool to open a flow path between the first chamber and the central bore, wherein the actuating includes:

engaging an object with a seat of a sleeve disposed in the central bore, thereby preventing fluid flow between a first port of the running tool and a second port of the running tool; and increasing pressure above the object to pressurize a second chamber between a piston sleeve and a tubular body of the running tool to move the piston sleeve from a closed position to an open position to open the flow path that is blocked by a seal assembly when the piston sleeve is in the closed position, wherein the seal assembly is disposed between the first and second ports; and increasing pressure in the first chamber to set a liner hanger of the LHA after actuating the running tool.

19. The method of claim 18, further comprising:

moving the running tool from a locked position to an unlocked position to release the LHDA from the LHA after setting the liner hanger, wherein the flow path remains open when the running tool is in the unlocked position.

20. The method of claim 19, the LHDA further including a packer actuator, a seal bypass, and a packoff having a seal stack, the method further comprising:

lifting the LHDA relative to the LHA to withdraw the packer actuator from a polished bore receptacle of the LHA and to position the seal bypass adjacent the seal stack, wherein the first chamber is in fluid communication with a wellbore fluid via the seal bypass;

lowering the LHDA relative to the LHA to set a packer of the LHA with the packer actuator; and removing the LHDA from the wellbore.

* * * * *